US009636568B2

(12) United States Patent
Ito et al.

(10) Patent No.: US 9,636,568 B2
(45) Date of Patent: May 2, 2017

(54) BASEBALL OR SOFTBALL GLOVE

(71) Applicant: Mizuno Corporation, Osaka (JP)

(72) Inventors: Norifumi Ito, Osaka (JP); Mieko Nagano, Osaka (JP); Kenji Maeda, Osaka (JP); Shigeki Kuroda, Osaka (JP)

(73) Assignee: MIZUNO CORPORATION, Osaka (JP)

( * ) Notice: Subject to any disclaimer, the term of this patent is extended or adjusted under 35 U.S.C. 154(b) by 0 days.

(21) Appl. No.: 14/499,434

(22) Filed: Sep. 29, 2014

(65) Prior Publication Data

US 2015/0089705 A1 Apr. 2, 2015

(30) Foreign Application Priority Data

Oct. 1, 2013 (JP) ..... 2013-206444

(51) Int. Cl.
*A41D 1/08* (2006.01)
*A63B 71/14* (2006.01)
*A63B 102/18* (2015.01)

(52) U.S. Cl.
CPC ..... *A63B 71/143* (2013.01); *A63B 2102/18* (2015.10)

(58) Field of Classification Search
CPC ..... A63B 71/143; A63B 71/141; A63B 71/14; A63B 2069/0011; A63B 2102/18; A41D 19/01523; A41D 19/001; A41D 19/081; A41D 19/0006; A41D 19/00; A41D 13/087
See application file for complete search history.

(56) References Cited

U.S. PATENT DOCUMENTS 528,343 A * 10/1894 Rogers ..... A63B 71/143 2/19
1,552,080 A * 9/1925 Rainey ..... A63B 71/143 2/19
3,321,771 A * 5/1967 Latina ..... A63B 71/143 2/19
3,698,045 A * 10/1972 Redden ..... E04H 15/22 24/580.1
3,909,848 A * 10/1975 Brockman ..... A63B 71/143 2/19

(Continued)

FOREIGN PATENT DOCUMENTS

JP 2012192207 A 10/2012

*Primary Examiner* — Khaled Annis
(74) *Attorney, Agent, or Firm* — Troutman Sanders, LLP; James E. Schutz; Daniel T. Sharpe

(57) ABSTRACT

A glove includes: a first leather member on a side of a ball catching plane; a second leather member disposed to face the first leather member; and a connection portion in which the first leather member and the second leather member are connected at a part of an outer peripheral portion of the ball catching plane. The connection portion includes a first loop contiguous to the first leather member and having a central axis, a second loop disposed adjacent to the first loop in a direction along the central axis and contiguous to the second leather member, and a string member passing through the first loop and the second loop along the central axis. At least one identical string member passes through the first loop and the second loop.

7 Claims, 38 Drawing Sheets

(56) References Cited

U.S. PATENT DOCUMENTS

| | | | | | |
|---|---|---|---|---|---|
| 4,192,018 | A * | 3/1980 | Latina | A63B 71/143 2/19 |
| 4,366,580 | A * | 1/1983 | Zidele | A63B 71/143 2/19 |
| 5,694,641 | A * | 12/1997 | Doi | A63B 71/143 2/161.1 |
| 6,571,394 | B1 * | 6/2003 | Hackett | A63B 71/143 2/19 |
| 2005/0120453 | A1 * | 6/2005 | Wu | A63B 71/143 2/19 |
| 2009/0300814 | A1 * | 12/2009 | Kume | A63B 71/143 2/19 |

* cited by examiner

BASEBALL OR SOFTBALL GLOVE

This nonprovisional application is based on Japanese Patent Application No. 2013-206444 filed on Oct. 1, 2013 with the Japan Patent Office, the entire contents of which are hereby incorporated by reference.

BACKGROUND OF THE INVENTION

Field of the Invention

The present invention relates to a baseball or softball catching tool, and particularly to a baseball or softball catching tool having a connection portion between a plurality of leather members.

Description of the Background Art

For example, Japanese Patent Laying-Open No. 2012-192207 conventionally discloses a baseball or softball catching tool having a configuration in which a plurality of (for example, two) leather members on the ball catching plane side are connected by a leather string. According to Japanese Patent Laying-Open No. 2012-192207, two leather members forming a ball catching plane side of the ball catching tool are connected at outer edge portions extending along the outer peripheral portions of these leather members in a wrist portion covering the user's wrist by a leather string wound around the outer peripheral portions of the outer edge portions. Furthermore, similarly in the wrist portion, these two leather members are connected also in each outer peripheral portion of each web portion provided between a portion receiving the user's thumb and a portion receiving the user's forefinger.

However, according to the ball catching tool disclosed in Japanese Patent Laying-Open No. 2012-192207, when the user performs an action to close its palm for catching a ball while wearing this ball catching tool, it becomes difficult for the user to cause the ball catching tool to follow the movement of the user's hand and bend this ball catching tool in the outer peripheral portions of the wrist portion and the web portion. This is because the outer peripheral portions of the leather members are connected by the leather string winding around these outer peripheral portions, and thereby, hardened. When the ball catching tool is difficult to be bent in this way, it may be difficult for the user to carry out a ball catching action using this ball catching tool.

The present invention has been made in light of the above-described problems. An object of the present invention is to provide a baseball or softball catching tool that is readily bent and readily caused to follow the movement of the user's hand (that is, easy to use).

SUMMARY OF THE INVENTION

A baseball or softball catching tool according to an embodiment of the present invention includes: a first leather member on a side of a ball catching plane; a second leather member disposed to face the first leather member; and a connection portion in which the first leather member and the second leather member are connected at an outer peripheral portion of the ball catching plane. The connection portion includes a first loop contiguous to the first leather member and having a central axis, a second loop disposed adjacent to the first loop in a direction along the central axis and contiguous to the second leather member, and a string member passing through the first loop and the second loop along the central axis.

According to the present invention, the first leather member and the second leather member are connected in the connection portion by the first and second loops contiguous to these first and second leather members, respectively, and by the string member passing through the first and second loops along the central axis thereof. Therefore, the baseball or softball catching tool is more readily bent at the connection portion than the conventional ball catching tool, and can be caused to readily follow the movement of the user's hand.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

The embodiments of the present invention will be hereinafter described with reference to the accompanying drawings.

(First Embodiment)

Figure 1:
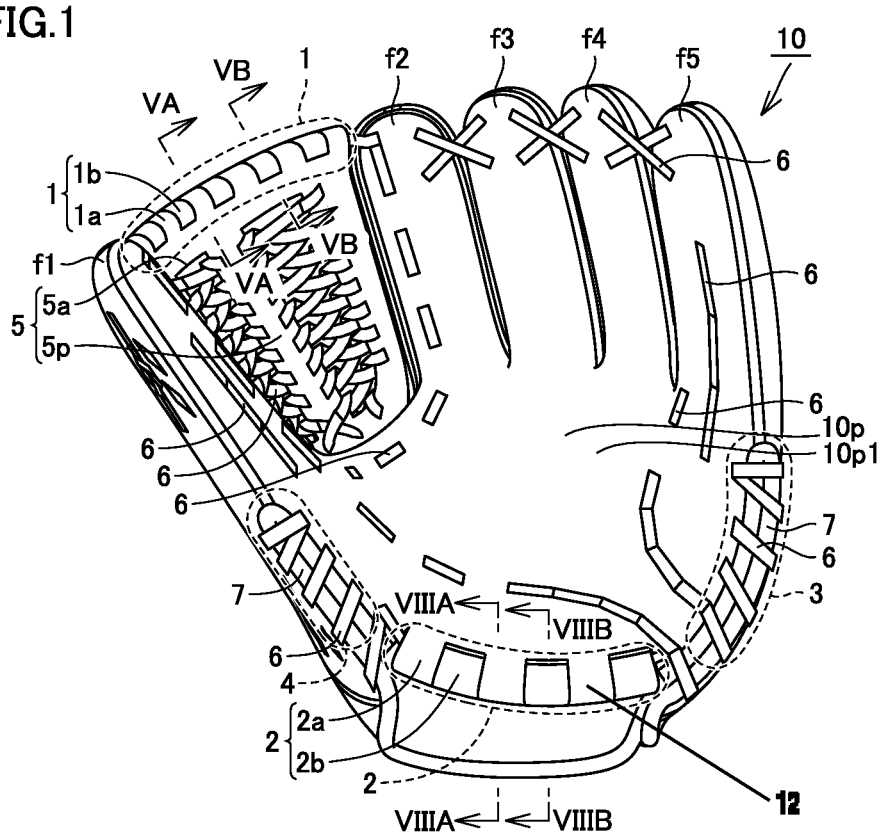
FIG. 1 is a schematic diagram showing the configuration of a region including a ball catching plane leather disposed on the palm side of the user's hand according to a ball catching tool of the first embodiment.
Figure 2:
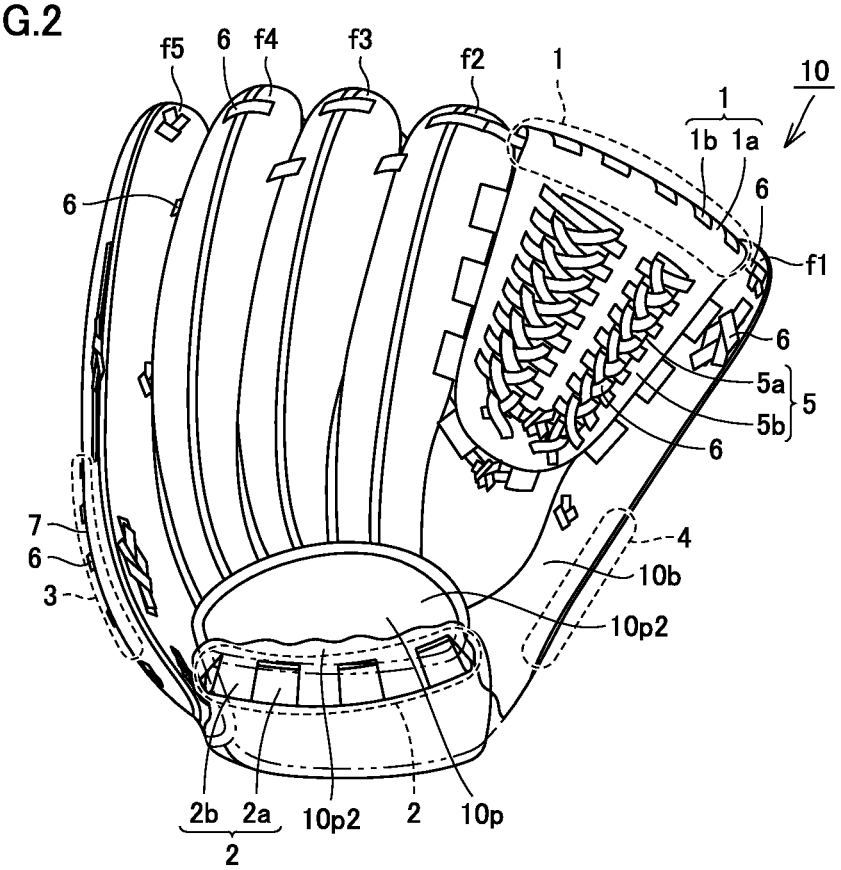
FIG. 2 is a schematic diagram showing the configuration of a region including a back leather disposed on the back side of the user's hand according to the ball catching tool of the first embodiment.

Referring to FIGS. 1 and 2, a glove 10 used as a baseball or softball catching tool according to the present embodiment includes: a palm-side disposed leather 10*p* disposed on the palm side of the user's hand that is to be inserted; and a back leather 10*b* disposed on the back side of the user's hand. In other words, the user's hand is inserted between palm-side disposed leather 10*p* and back leather 10*b*. The opening for the insertion of the user's hand is located adjacent to heel portion 12 of the glove 10.

Palm-side disposed leather 10*p* includes: a ball catching plane leather 10*p*1 having a plane on which the user catches a ball (a ball catching plane with which the ball received by the user comes in contact); and a palm leather 10*p*2 disposed to face ball catching plane leather 10$p$1 and coming in contact with the palm of the inserted user's hand. Ball catching plane leather 10$p$1 and palm leather 10$p$2 are connected by a leather string wound from the outside and integrated with each other as palm-side disposed leather 10$p$. As shown in FIG. 2, most of palm leather 10$p$2 is covered by back leather 10$b$ and therefore less exposed. In contrast, back leather 10$b$ is provided with an opening that allows exposure of a part of the back side of the user's hand that is somewhat close to the user's fingers relative to the user's wrist, and a part of palm leather 10$p$2 is exposed through this opening in FIG. 2.

Palm-side disposed leather 10$p$ (ball catching plane leather 10$p$1 and palm leather 10$p$2) and back leather 10$b$ are made, for example, of synthetic leather, natural leather, artificial leather, or other materials having characteristics similar to those of such leather. Furthermore, most of members forming glove 10 according to the present embodiment that will be described later are basically made of a material similar to those described above.

Palm-side disposed leather 10$p$ (ball catching plane leather 10$p$1 and palm leather 10$p$2) and back leather 10$b$ both form finger stalls that can receive the user's fingers. Specifically, ball catching plane leather 10$p$1, palm leather 10$p$2, and back leather 10$b$ each include: a thumb stall f1 that can receive the user's thumb; a forefinger stall f2 that can receive the user's forefinger; a middle finger stall f3 that can receive the user's middle finger; a ring finger stall f4 that can receive the user's ring finger; and a little finger stall f5 that can receive the user's little finger. Finger stalls f1 to f5 of palm-side disposed leather 10$p$ and finger stalls f1 to f5 of back leather 10$b$ are respectively sewn to each other partially at their respective outer peripheral portions by the commonly known method. Thereby, regions into which the user's fingers can be inserted are formed between finger stalls f1 to f5 of palm-side disposed leather 10$p$ and finger stalls f1 to f5 of back leather 10$b$.

A web portion 5 is provided between thumb stall f1 and forefinger stall f2. Web portion 5 has a palm-side web portion 5$p$ and a back-side web portion 5$b$. Palm-side web portion 5$p$ includes a plane on which the user catches a ball as in the case of ball catching plane leather 10$p$1. Back-side web portion 5$b$ is disposed to face in the same direction as back leather 10$b$ faces.

In addition, for example, finger stalls f2 to f5 are coupled to each other by a leather string 6 similar to leather string 6 in web portion 5 described above. Furthermore, in wrist adjoining connection portions 3 and 4 (connection portions each extending in the direction at an angle to the direction in which a hand insertion connection portion 2 (described later in detail) extends) included in the outer peripheral portion of each of palm-side disposed leather 10$p$ and back leather 10$b$ and adjoining hand insertion connection portion 2, leather string 6 is wound around the outer peripheral portion of an outer edge portion 7, thereby connecting palm-side disposed leather 10$p$ (specifically, ball catching plane leather 10$p$1 and palm leather 10$p$2) and back leather 10$b$.

A web connection portion 1 is formed in a part of the outer peripheral portion of web portion 5. The outer peripheral portion used herein means the outermost edge portion (and its neighboring area) of glove 10 shown in FIGS. 1 and 2. Web connection portion 1 connects palm-side web portion 5$p$ serving as the first leather member on the ball catching plane side and back-side web portion 5$b$ serving as the second leather member disposed to face palm-side web portion 5$p$, in which palm-side web portion 5$p$ and back-side web portion 5$b$ form web portion 5. Web connection portion 1 (connection portion) is located at the outer peripheral portion of the ball catching plane, that is, at the outermost edge portion of palm-side web portion 5$p$ that is located along the tip end of each of finger stalls f1 to f5.

Furthermore, glove 10 has a hand insertion portion into which the hand of the user wearing this glove is inserted. This hand insertion portion is opened such that the user's hand can be inserted into a region sandwiched between palm-side disposed leather 10$p$ and back leather 10$b$. In other words, the hand insertion portion is an entry/exit port of a region housing the user's hand and formed by connecting the outer peripheral portions of palm-side disposed leather 10$p$ and back leather 10$b$. The hand insertion portion is formed along the outer peripheral portions of palm-side disposed leather 10$p$ and back leather 10$b$, but these palm-side disposed leather 10$p$ and back leather 10$b$ are not directly connected in this hand insertion portion for the purpose of providing an opening as an entry/exit port.

Palm-side disposed leather 10$p$ has ball catching plane leather 10$p$1 and palm leather 10$p$2 as described above. Since a ball is caught in the ball catching plane of ball catching plane leather 10$p$1, ball catching plane leather 10$p$1 is disposed as the first leather member on the ball catching plane side. Furthermore, palm leather 10$p$2 is disposed as the second leather member facing ball catching plane leather 10$p$1, and includes a plane that comes in contact with the user's hand. In addition, a region housing a user's hand is formed between this palm leather 10$p$2 and back leather 10$b$. In the hand insertion portion, ball catching plane leather 10$p$1 and palm leather 10$p$2 are connected by hand insertion connection portion 2 (connection portion) at the outer peripheral portion of its ball catching plane, that is, at the outermost edge portion of palm-side disposed leather 10$p$.

Web connection portion 1 has a web loop 1$a$ (the first loop) and a web loop 1$b$ (the second loop), in which web loops 1$a$ and web loops 1$b$ are alternately arranged so as to be adjacent to each other in the direction in which web connection portion 1 (the outer peripheral portion of glove 10) extends. For example, in the present embodiment, five web loops 1$b$ are arranged in line in the horizontal direction in FIG. 1 in which web connection portion 1 extends. In other words, 5-pitch web loops 1$b$ are provided in the present embodiment. Similarly, hand insertion connection portion 2 has a hand insertion portion loop 2$a$ (the first loop) and a hand insertion portion loop 2$b$ (the second loop), in which hand insertion portion loops 2$a$ and hand insertion portion loops 2$b$ are alternately arranged so as to be adjacent to each other in the direction in which hand insertion connection portion 2 (the outer peripheral portion of glove 10) extends. In addition, FIG. 2 shows a region below a wavy line in perspective view such that hand insertion portion loops 2$a$ and 2$b$ can be visually recognized.

For example, in the present embodiment, three hand insertion portion loops 2$b$ are arranged in line in the horizontal direction in FIG. 1 in which hand insertion connection portion 2 extends. In other words, 3-pitch hand insertion portion loops 2$b$ are provided in the present embodiment, which will be hereinafter described with reference to FIGS. 3 to 8B. First, web connection portion 1 will be described with reference to FIGS. 3 to 5B.

Figure 3:
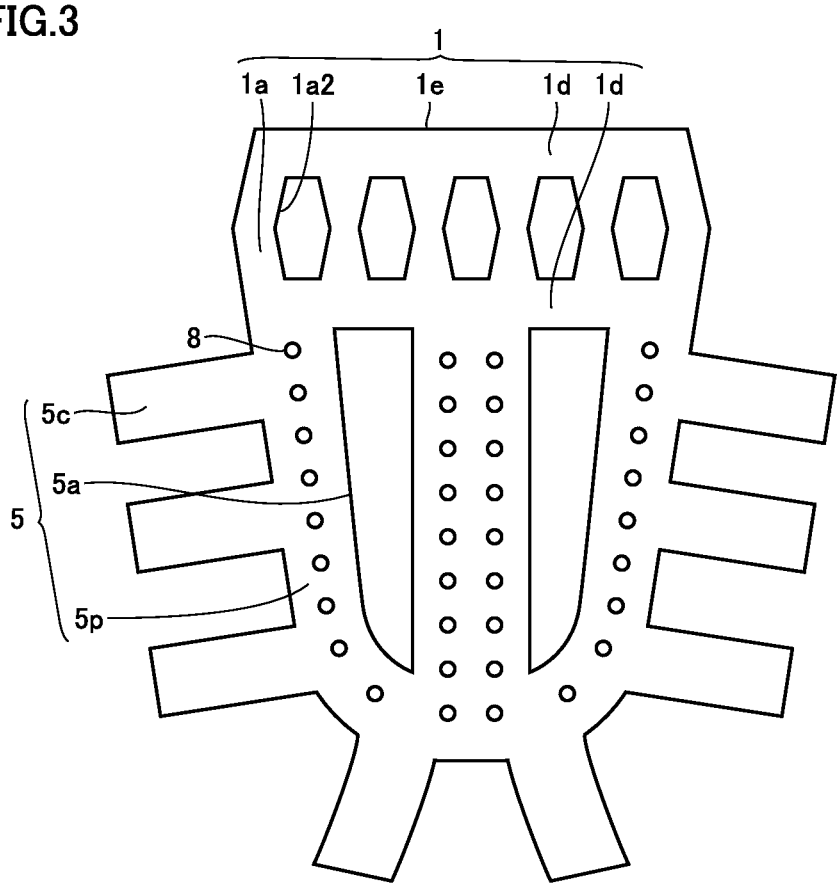
FIG. 3 is a plan view showing the developed state of a member including the first loop and forming a web connection portion in FIGS. 1 and 2.

Referring to FIG. 3, palm-side web portion 5$p$ of web portion 5 and web loop 1$a$ of web connection portion 1 are integrated with each other in the present embodiment. Palm-side web portion 5$p$ may include a web opening 5$a$, a protrusion for sewing 5$c$ used for sewing this palm-side web portion 5$p$ and other members (for example, thumb stall f1 and forefinger stall f2), and a hole 8 through which leather string 6 is caused to pass. In this case, for ease of explanation, a region 1*a* used for forming a loop (no loop is actually formed in the development view in FIG. 3) is also represented similarly to the case of web loop 1*a* actually formed as shown in FIG. 1.

Figure 4:
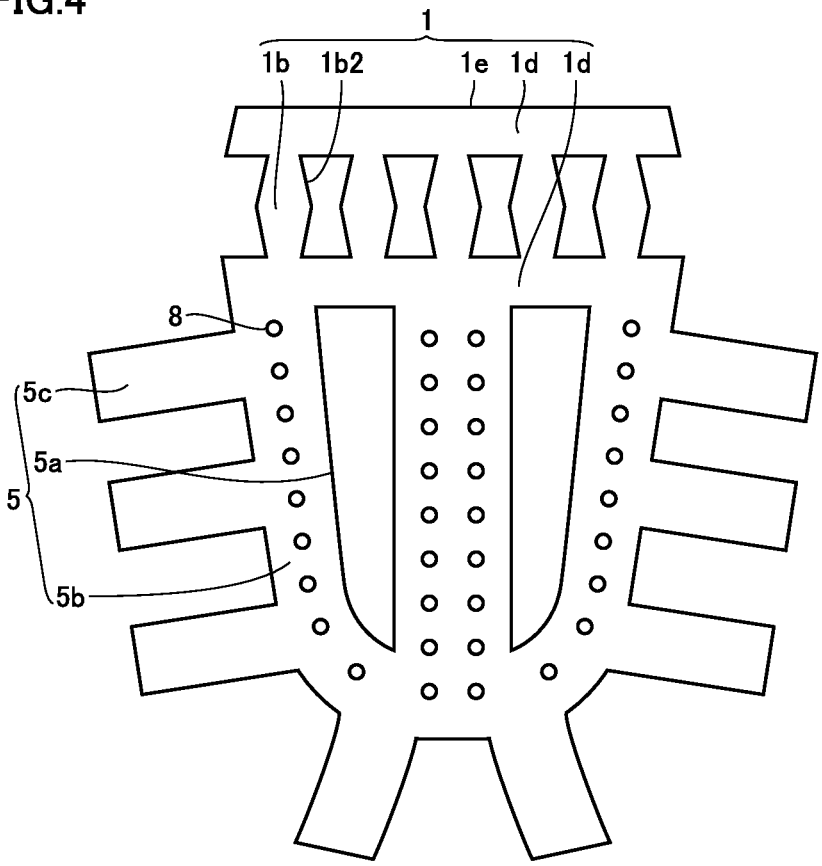
FIG. 4 is a plan view showing the developed state of a member including the second loop and forming the web connection portion in FIGS. 1 and 2.

Referring to FIG. 4, back-side web portion 5*b* of web portion 5 and web loop 1*b* of web connection portion 1 are integrated with each other in the present embodiment. Palm-side web portion 5*p* may include a web opening 5*a*, a protrusion for sewing 5*c* used for sewing this palm-side web portion 5*p* and other members, and a hole 8 through which leather string 6 is caused to pass.

Palm-side web portion 5*p* in FIG. 3 and back-side web portion 5*b* in FIG. 4 are almost identical in shape and size in plan view, and overlapped with each other so as to be arranged back to back. Thereby, palm-side web portion 5*p* and back-side web portion 5*b* are integrated with each other to form web portion 5. The term "back to back" used herein means that the surface of palm-side web portion 5*p* faces in the same direction as the surface of ball catching plane leather 10*p*1 while the surface of back-side web portion 5*b* faces in the same direction as the surface of back leather 10*b*, so that these surfaces of web portions 5*p* and 5*b* face in the opposite directions.

As to web loop 1*a*, web loops 1*a* and web loop openings 1*a*2 are alternately provided so as to be adjacent to each other in the horizontal direction in FIG. 3, that is, in the direction in which web connection portion 1 extends. Also, these web loops 1*a* and web loop openings 1*a*2 extend in the vertical direction in FIG. 3. Accordingly, each web loop 1*a* is combined with each pair of loop sewing portions 1*d* located above and below web loop 1*a* in FIG. 3, thereby forming a ladder shape. Furthermore, web loop 1*b* is also basically the same as web loop 1*a*. Web loops 1*b* and web loop openings 1*b*2 are alternately provided so as to be adjacent to each other in the horizontal direction in FIG. 4, that is, in the direction in which web connection portion 1 extends. Also, web loops 1*b* and web loop openings 1*b*2 extend in the vertical direction in FIG. 4. Accordingly, each web loop 1*b* is combined with each pair of loop sewing portions 1*d* located above and below web loop 1*b* in FIG. 4, thereby forming a ladder shape.

When palm-side web portion 5*p* in FIG. 3 and back-side web portion 5*b* in FIG. 4 are overlapped with each other so as to be arranged back to back, web loops 1*a* and web loops 1*b* are alternately arranged so as to be adjacent to each other in the horizontal direction of the figure. Specifically, web loop opening 1*a*2 in FIG. 3 is located so as to allow web loop 1*b* in FIG. 4 to be disposed at web loop opening 1*a*2 in FIG. 3 while web loop opening 1*b*2 in FIG. 4 is located so as to allow web loop 1*a* in FIG. 3 to be disposed at web loop opening 1*b*2 in FIG. 4.

Figure 5A:
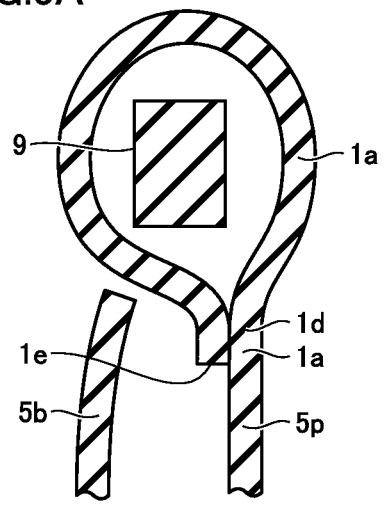
FIG. 5A is a cross-sectional view showing the state of the first web loop integrated with the web connection portion and a string member passing through the first web loop.

FIG. 5A is a schematic cross-sectional view of a portion, for example, along a line VA-VA in FIG. 1. Referring to FIG. 5A, in the structure in which palm-side web portion 5*p* and web loop 1*a* in FIG. 3 are integrally contiguous to each other, for example, a loop end 1*e* in FIG. 3 and a web sewing portion 1*d* below web loop 1*a* are sewn while being overlapped with each other, and a pair of loop sewing portions 1*d* adjacent to portions located above and below web loop 1*a* are sewn while being overlapped with each other, thereby forming a loop having an annular cross-sectional shape. This loop 1*a* corresponds to web loop 1*a* in FIG. 1.

In FIG. 5A, the right side of the figure corresponds to the ball catching plane leather 10*p*1 side while the left side of the figure corresponds to the back leather 10*b* side. Thus, on the lower right side of web loop 1*a*, palm-side web portion 5*p* contiguously integrated with this web loop 1*a* extends in the downward direction of the figure while back-side web portion 5*b* extends in the downward direction of the figure so as to face palm-side web portion 5*p*. Also in FIG. 5A, for the sake of illustration, web loop 1*a* expands in the horizontal direction of the figure, and a space exists between palm-side web portion 5*p* and back-side web portion 5*b* below web loop 1*a*, but palm-side web portion 5*p* and back-side web portion 5*b* may be closely in contact with each other. In a further downward region that is not shown, these palm-side web portion 5*p* and back-side web portion 5*b* are connected to each other so as to be arranged back to back (by leather string 6 through web opening 5*a* or the like).

Figure 5B:
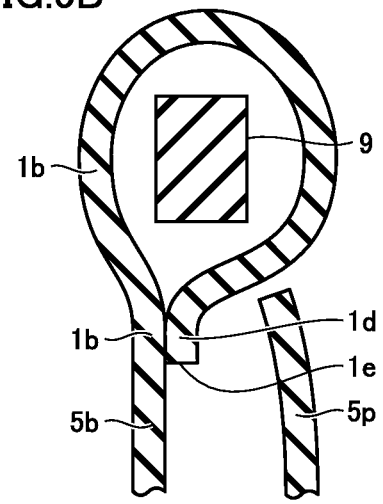
FIG. 5B is a cross-sectional view showing the state of the second web loop integrated with the web connection portion and the string member passing through the second web loop.

FIG. 5B is a schematic cross-sectional view of a portion, for example, along a line VB-VB in FIG. 1. Referring to FIG. 5B, in the structure in which back-side web portion 5*b* and web loop 1*b* in FIG. 4 are integrally contiguous to each other basically as in FIG. 5A, for example, loop end 1*e* in FIG. 4 and web sewing portion 1*d* below web loop 1*b* are sewn while being overlapped with each other, and a pair of loop sewing portions 1*d* adjacent to portions located above and below web loop 1*b* are sewn while being overlapped with each other, thereby forming a loop having an annular cross-sectional shape. This loop 1*b* corresponds to web loop 1*b* in FIG. 1.

Also in FIG. 5B, the right side of the figure corresponds to the ball catching plane leather 10*p*1 side while the left side of the figure corresponds to the back leather 10*b* side. Accordingly, on the lower left side of web loop 1*b*, back-side web portion 5*b* contiguously integrated with this web loop 1*b* extends in the downward direction of the figure, and palm-side web portion 5*p* extends in the downward direction of the figure so as to face back-side web portion 5*b*. Also in FIG. 5B, for the sake of illustration, web loop 1*b* expands in the horizontal direction of the figure, and a space exists between palm-side web portion 5*p* and back-side web portion 5*b* disposed below web loop 1*b*, but palm-side web portion 5*p* and back-side web portion 5*b* may be closely in contact with each other. In a further downward region that is not shown, these palm-side web portion 5*p* and back-side web portion 5*b* are connected to each other so as to be arranged back to back (by leather string 6 through web opening 5*a* or the like).

Again referring to FIGS. 5A and 5B, web loops 1*a* in FIG. 5A and web loops 1*b* in FIG. 5B are alternately arranged so as to be adjacent to each other in the direction perpendicular to the surface of the sheet of paper showing the figure, that is, in the horizontal direction in FIG. 1. Accordingly, web loop 1*a* in FIG. 5A and web loop 1*b* in FIG. 5B are overlapped with each other so as to both extend along the central axis extending in the direction perpendicular to the surface of the sheets of paper. Then, a member including a plurality of web loops 1*a* and a member including a plurality of web loops 1*b* are connected by a loop penetration string 9 as a string member that passes through the holes of web loops 1*a* and web loops 1*b* so as to extend along the above-described central axis. Thus, web connection portion 1 is formed by a plurality of web loops 1*a*, a plurality of web loops 1*b*, and loop penetration string 9.

As described above, web loops 1*a* and web loops 1*b* extending from palm-side web portion 5*p* and back-side web portion 5*b*, respectively, that face in the opposite directions are alternately arranged so as to be adjacent to each other, and connected by loop penetration string 9 passing through these web loops 1*a* and 1*b* along the common central axis of these web loops 1*a* and 1*b*.

Web loop 1*a* and web loop 1*b* are connected to each other by at least one (the number of which may be two or more) and the same loop penetration string 9 passing through these web loops 1*a* and 1*b*.

Then, hand insertion connection portion 2 will be hereinafter described with reference to FIGS. 6 to 8B.

Figure 6:
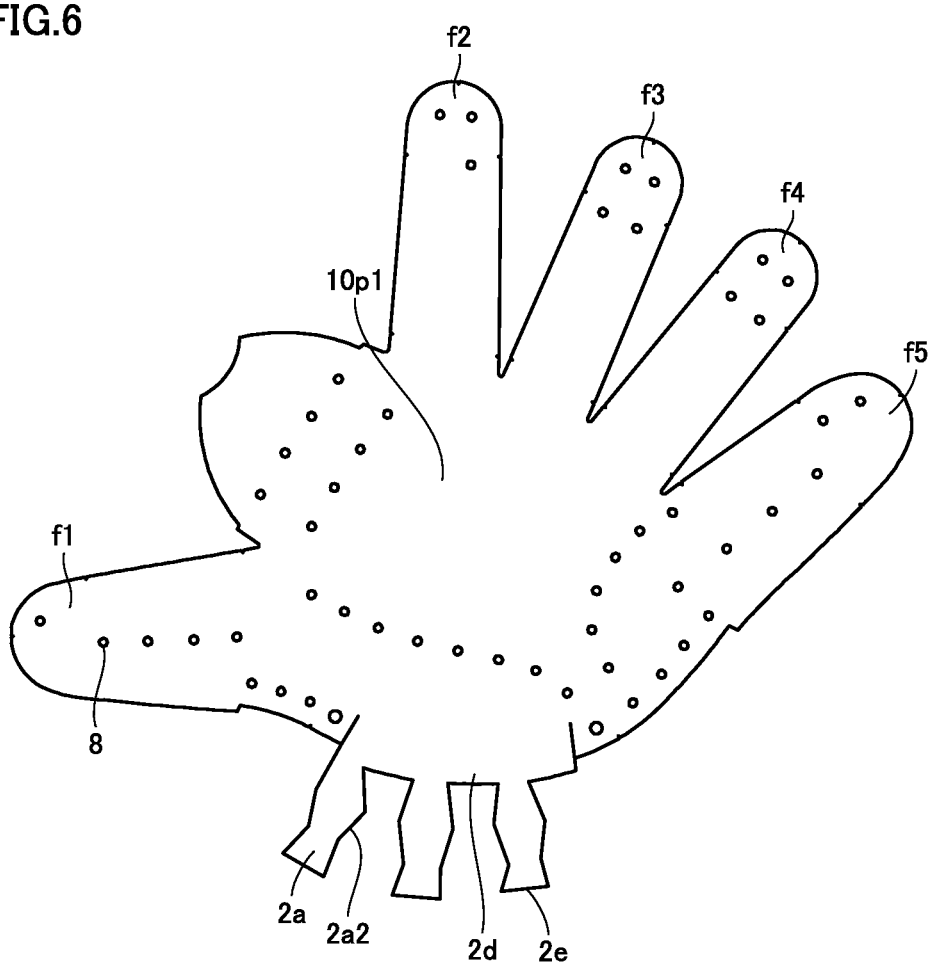
FIG. 6 is a plan view showing the developed state of a member including the first loop and forming a hand insertion connection portion in FIGS. 1 and 2.

Referring to FIG. 6, ball catching plane leather 10*p*1 of palm-side disposed leather 10*p* and hand insertion portion loop 2*a* forming a hand insertion portion are integrated with each other in the present embodiment. Ball catching plane leather 10*p*1 may also be provided with hole 8 through which leather string 6 is caused to pass. Furthermore, a space for providing web portion 5 is ensured between thumb stall f1 and forefinger stall f2. In addition, for ease of explanation, regions f1 to f5 for forming finger stalls (no finger stall is actually formed in the development view in FIG. 6) are also represented similarly to finger stalls f1 to f5 that are actually formed as shown in FIG. 1.

Figure 7:
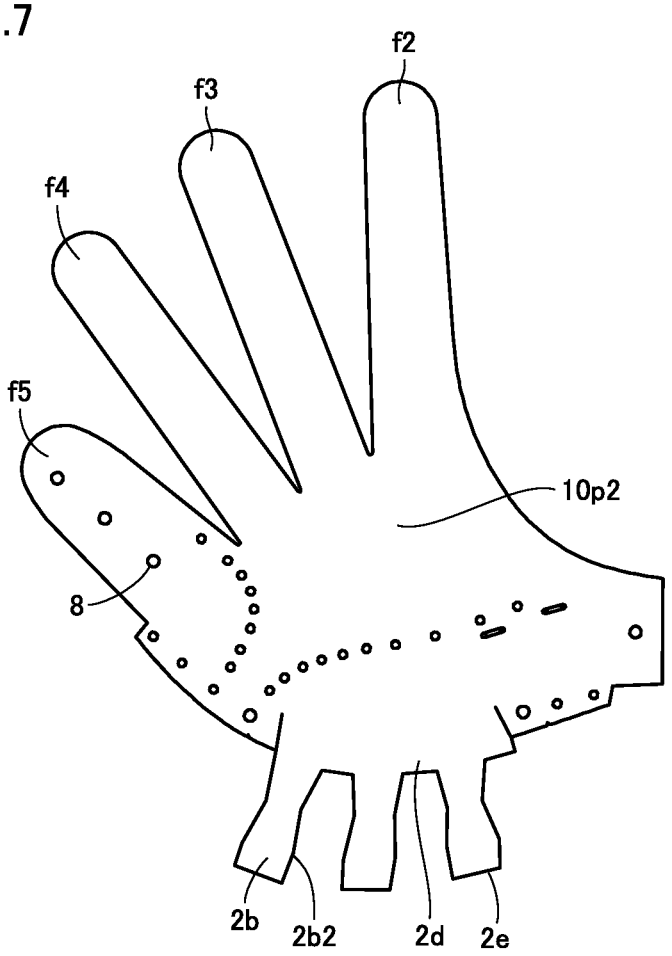
FIG. 7 is a plan view showing the developed state of a member including the second loop and forming the hand insertion connection portion in FIGS. 1 and 2.

Referring to FIG. 7, palm leather 10*p*2 of palm-side disposed leather 10*p* and hand insertion portion loop 2*b* forming a hand insertion portion are integrated with each other in the present embodiment. Ball catching plane leather 10*p*1 may also be provided with hole 8 through which leather string 6 is caused to pass.

Ball catching plane leather 10*p*1 in FIG. 6 and palm leather 10*p*2 in FIG. 7 are almost identical in shape and size in plan view though slightly different from each other. These ball catching plane leather 10*p*1 and palm leather 10*p*2 are overlapped with each other so as to be arranged back to back and integrated with each other, thereby forming palm-side disposed leather 10*p*. Specifically, ball catching plane leather 10*p*1 and palm leather 10*p*2 are connected so as to face in the opposite directions such that the surface of ball catching plane leather 10*p*1 faces in the same direction as the palm of the hand of the user who wears glove 10 and such that the surface of palm leather 10*p*2 faces in the same direction as the back side of the hand of the user who wears glove 10.

As to hand insertion portion loop 2*a*, hand insertion portion loops 2*a* and hand insertion portion loop openings 2*a*2 are alternately provided so as to be adjacent to each other in the horizontal direction in FIG. 6, that is, in the direction in which hand insertion connection portion 2 extends. Hand insertion portion loops 2*a* and hand insertion portion loop openings 2*a*2 extend generally in the vertical direction in FIG. 6. Accordingly, each hand insertion portion loop 2*a* is combined with each loop sewing portion 2*d* extending above hand insertion portion loop 2*a* as seen in FIG. 6, thereby forming a comb shape. Furthermore, hand insertion portion loop 2*b* is also basically the same as hand insertion portion loop 2*a*. Thus, hand insertion portion loops 2*b* and hand insertion portion loop openings 2*b*2 are alternately provided so as to be adjacent to each other in the horizontal direction in FIG. 7, that is, in the direction in which hand insertion connection portion 2 extends. Hand insertion portion loops 2*b* and hand insertion portion loop openings 2*b*2 extend in the vertical direction in FIG. 7. Accordingly, each hand insertion portion loop 2*b* is combined with each loop sewing portion 2*d* extending above hand insertion portion loop 2*b* as shown in FIG. 7, thereby forming a comb shape.

Also in hand insertion connection portion 2, as with web connection portion 1, hand insertion portion loops 2*a* and hand insertion portion loops 2*b* are alternately arranged so as to be adjacent to each other in the horizontal direction of the figure when ball catching plane leather 10*p*1 in FIG. 6 and palm leather 10*p*2 in FIG. 7 are overlapped with each other so as to be arranged back to back. Specifically, hand insertion portion loop opening 2*a*2 in FIG. 6 is located so as to allow hand insertion portion loop 2*b* in FIG. 7 to be disposed at hand insertion portion loop opening 2*a*2 in FIG. 6 while hand insertion portion loop opening 2*b*2 in FIG. 7 is located so as to allow hand insertion portion loop 2*a* in FIG. 6 to be disposed at hand insertion portion loop opening 2*b*2 in FIG. 7.

Figure 8A:
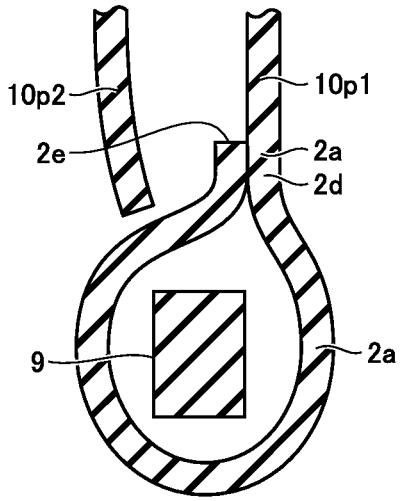
FIG. 8A is a cross-sectional view showing the state of the first hand insertion portion loop integrated with the ball catching plane leather and the string member passing through the first hand insertion portion loop.

FIG. 8A is a schematic cross-sectional view of a portion, for example, along a line VIIIA-VIIIA in FIG. 1. Referring to FIG. 8A, basically similarly to FIG. 5A, in the structure in which ball catching plane leather 10*p*1 and hand insertion portion loop 2*a* in FIG. 6 are contiguously integrated with each other, for example, a portion near loop end 2*e* in FIG. 6 and loop sewing portion 2*d* located above hand insertion portion loop 2*a* are sewn while being overlapped with each other, thereby forming a loop having an annular cross-sectional shape. This loop 2*a* corresponds to hand insertion portion loop 2*a* in FIG. 1.

In FIG. 8A, the right side of the figure corresponds to the ball catching plane leather 10*p*1 side while the left side of the figure corresponds to the back leather 10*b* side. Thus, on the upper right side of hand insertion portion loop 2*a*, ball catching plane leather 10*p*1 contiguously integrated with this hand insertion portion loop 2*a* extends in the upward direction in the figure, and palm leather 10*p*2 extends in the upward direction of the figure so as to face ball catching plane leather 10*p*1. Also in FIG. 8A, for the sake of illustration, hand insertion portion loop 2*a* expands in the horizontal direction of the figure, and a space exists between ball catching plane leather 10*p*1 and palm leather 10*p*2 above hand insertion portion loop 2*a*, but ball catching plane leather 10*p*1 and palm leather 10*p*2 may be closely in contact with each other. These ball catching plane leather 10*p*1 and palm leather 10*p*2 are connected so as to be arranged back to back (by outer edge portion 7 or the like) in a further upward region that is not shown.

Figure 8B:
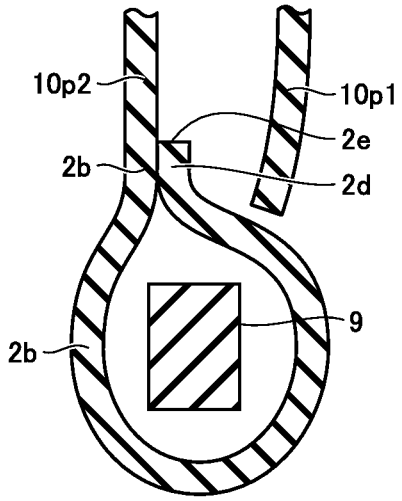
FIG. 8B is a cross-sectional view showing the state of the second hand insertion portion loop integrated with a palm leather and the string member passing through the second hand insertion portion loop.

FIG. 8B is a schematic cross-sectional view of a portion, for example, along a line VIIIB-VIIIB in FIG. 1. Referring to FIG. 8B, basically similarly to FIG. 8A, in the structure in which palm leather 10*p*2 and hand insertion portion loop 2*b* in FIG. 7 are contiguously integrated with each other, for example, loop end 2*e* in FIG. 7 and loop sewing portion 2*d* located above hand insertion portion loop 2*b* are sewn while being overlapped with each other, thereby forming a loop having an annular cross-sectional shape. This loop 2*b* corresponds to hand insertion portion loop 2*b* in FIG. 1.

Also in FIG. 8B, the right side of the figure corresponds to the ball catching plane leather 10*p*1 side while the left side of the figure corresponds to the back leather 10*b* side. Accordingly, on the upper left side of hand insertion portion loop 2*b*, palm leather 10*p*2 contiguously integrated with this hand insertion portion loop 2*b* extends in the upward direction of the figure, and ball catching plane leather 10*p*1 extends in the upward direction of the figure so as to face palm leather 10*p*2. Also in FIG. 8B, for the sake of illustration, hand insertion portion loop 2*b* expands in the horizontal direction of the figure, and a space exists between ball catching plane leather 10*p*1 and palm leather 10*p*2 above hand insertion portion loop 2*b*, but ball catching plane leather 10*p*1 and palm leather 10*p*2 may be closely in contact with each other. In a further upward region that is not shown, these ball catching plane leather 10*p*1 and palm leather 10p2 are connected to each other so as to be arranged back to back (by outer edge portion 7 or the like).

Again referring to FIGS. 8A and 8B, hand insertion portion loops 2a in FIG. 8A and hand insertion portion loops 2b in FIG. 8B are alternately arranged so as to be adjacent to each other in the direction perpendicular to the surface of the sheet of paper showing the figure, that is, in the horizontal direction in FIG. 1. Accordingly, hand insertion portion loop 2a in FIG. 8A and hand insertion portion loop 2b in FIG. 8B are overlapped with each other so as to both extend along the central axis extending in the direction perpendicular to the surface of the sheet of paper. Then, a member including a plurality of hand insertion portion loops 2a and a member including a plurality of hand insertion portion loops 2b are connected by loop penetration string 9 that passes through the holes of hand insertion portion loop 2a and hand insertion portion loop 2b so as to extend along the above-described central axis. Thus, hand insertion connection portion 2 is formed by a plurality of hand insertion portion loops 2a, a plurality of hand insertion portion loops 2b, and loop penetration string 9.

As described above, hand insertion portion loops 2a and hand insertion portion loops 2b extending from ball catching plane leather 10p1 and palm leather 10p2, respectively, that face in the opposite directions are alternately arranged so as to be adjacent to each other, and connected by loop penetration string 9 that passes through these hand insertion portion loops 2a and 2b along the common central axis of these loops 2a and 2b.

Hand insertion portion loop 2a and hand insertion portion loop 2b are connected to each other by at least one (the number of which may be two or more) and the same loop penetration string 9 passing through these hand insertion portion loops 2a and 2b.

Then, the functions and effects of the present embodiment will be described.

Figure 9:
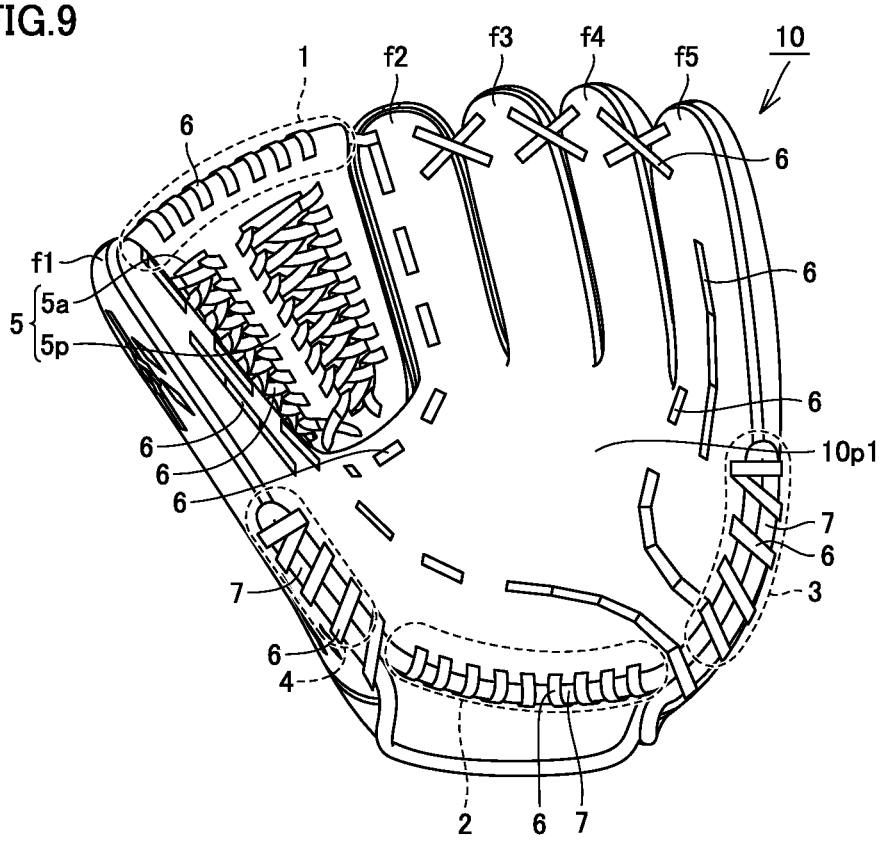
FIG. 9 is a schematic diagram showing the configuration of a region including a ball catching plane leather disposed on the palm side of the user's hand according to a ball catching tool of a comparative example.
Figure 10:
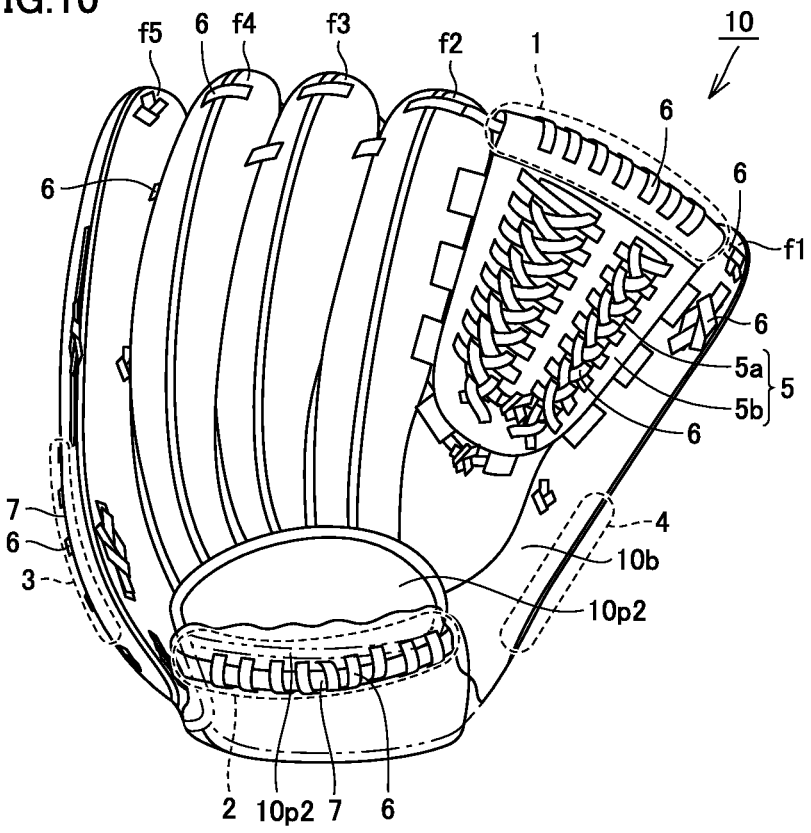
FIG. 10 is a schematic diagram showing the configuration of a region including a back leather disposed on the back side of the user's hand according to the ball catching tool of the comparative example.

Referring to FIGS. 9 and 10, in a comparative example of the present invention, the regions corresponding to web connection portion 1 and hand insertion connection portion 2 of the present embodiment have the same configuration as those of other regions. In other words, palm-side web portion 5p and back-side web portion 5b are not connected at web connection portion 1 by web loops 1a and 1b, but thin leather string 6 is caused to pass through holes (not shown) provided at regular intervals in the upper end portion obtained by folding back one sheet of leather. This thin leather string 6 is spirally wound between these holes and the outer surface of the upper end portion. The same also applies to hand insertion connection portion 2.

Since the configuration of the present embodiment other than the above is almost the same as that of the first embodiment shown in FIGS. 1 and 2, the same components are designated by the same reference characters, and the description thereof will not be repeated.

Basically, web connection portion 1 and hand insertion connection portion 2 each correspond to a region that is bent most largely when the user catches a ball. However, if the first leather member on the ball catching plane side and the second leather member facing thereto are connected in these regions by a leather string wound as in the comparative example described above, these connection portions are hardened, and therefore, become difficult to be bent.

Thus, as with web connection portion 1 and hand insertion connection portion 2 in the present embodiment, connection portions are provided that have the first loop and the second loop contiguously connected to the first leather member and the second leather member, respectively. In these connection portions, the first leather member and the second leather member, which are to be connected and face each other, are connected by a string member (loop penetration string 9) passing through the first and second loops along the common central axis of these loops. In this way, these connection portions 1 and 2 can be readily bent as compared with the comparative example, and thus, can be caused to readily follow the movement of the user's hand. Therefore, glove 10 can be bent with relatively smaller force, so that the ball catching action can be more readily carried out.

The same loop penetration string 9 passes through web loop 1a and web loop 1b. Accordingly, web loop 1a and web loop 1b can be readily bent further flexibly, for example, as compared with the case where separate loop penetration strings 9 pass through web loop 1a and web loop 1b, respectively.

Furthermore, in the present embodiment, as shown in FIGS. 3, 4, 6, and 7, the first loop is integrated with the first leather member while the second loop is integrated with the second leather member. Accordingly, the process can be more simplified as compared with the case where the first and second loops are formed separately from the first and second leather members, respectively.

(Second Embodiment)

Figure 11:
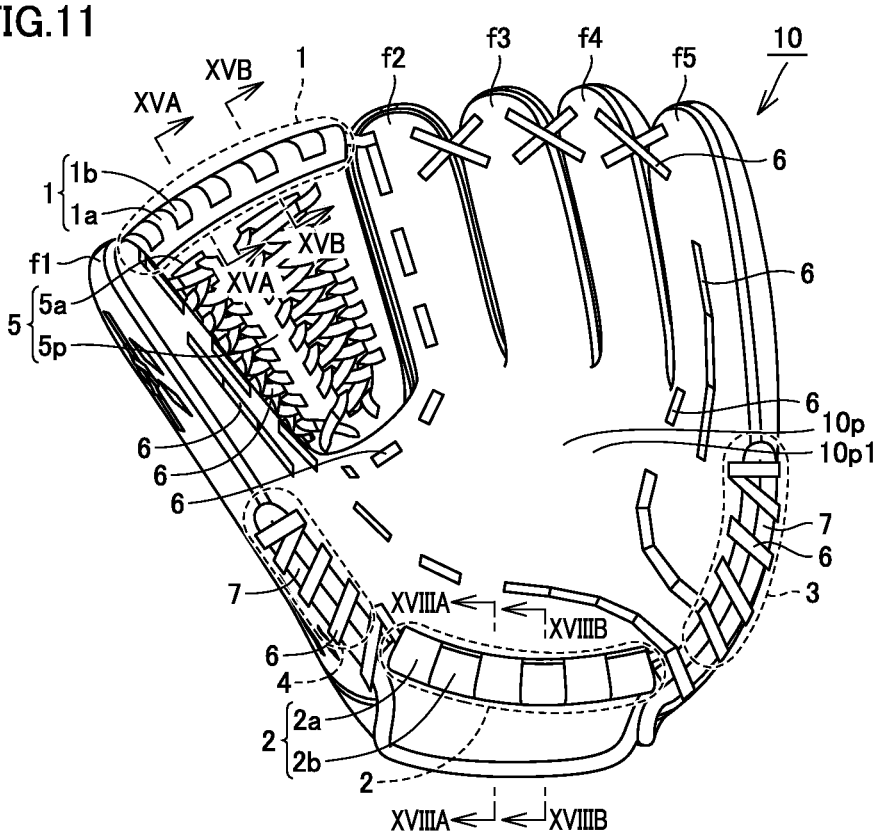
FIG. 11 is a schematic diagram showing the configuration of a region including a ball catching plane leather disposed on the palm side of the user's hand according to the ball catching tool of the second embodiment.
Figure 12:
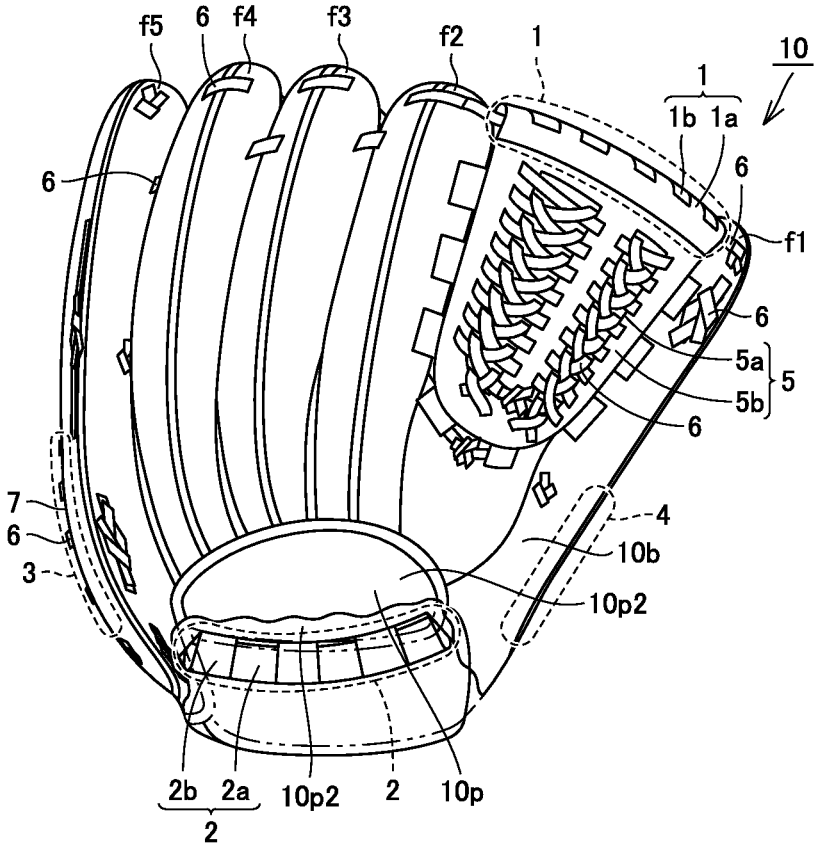
FIG. 12 is a schematic diagram showing the configuration of a region including a back leather disposed on the back side of the user's hand according to the ball catching tool of the second embodiment.

Referring to FIGS. 11 and 12, as compared with the configuration of the first embodiment shown in FIGS. 1 and 2, glove 10 used as a baseball or softball catching tool according to the present embodiment is different in a connection portion between web portion 5 and web connection portion 1 and in a connection portion between palm-side disposed leather 10p and hand insertion connection portion 2. Specifically, in the present embodiment, web portion 5 and web connection portion 1 that are separately provided are connected to each other while palm-side disposed leather 10p and hand insertion connection portion 2 that are also separately provided are connected to each other. The present embodiment is different in this point from the first embodiment in which web portion 5 and web connection portion 1 are integrally connected to each other while palm-side disposed leather 10p and hand insertion connection portion 2 are integrally connected to each other.

Figure 13:
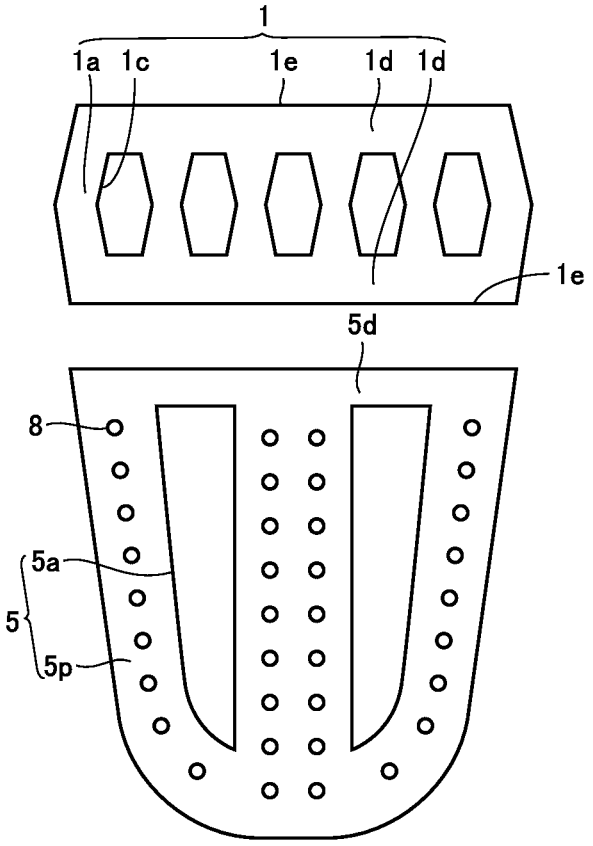
FIG. 13 is a plan view showing the developed state of a member including the first loop and forming a web connection portion in FIGS. 11 and 12.

Referring to FIG. 13, palm-side web portion 5p of web portion 5 and web loop 1a of web connection portion 1 are provided separately from each other in the present embodiment. However, in the points other than this, the present embodiment is basically the same as the first embodiment in FIG. 3. Also, web loop 1a and palm-side web portion 5p in the present embodiment are basically identical in shape and size in development view to web loop 1a and palm-side web portion 5p in the first embodiment.

Figure 14:
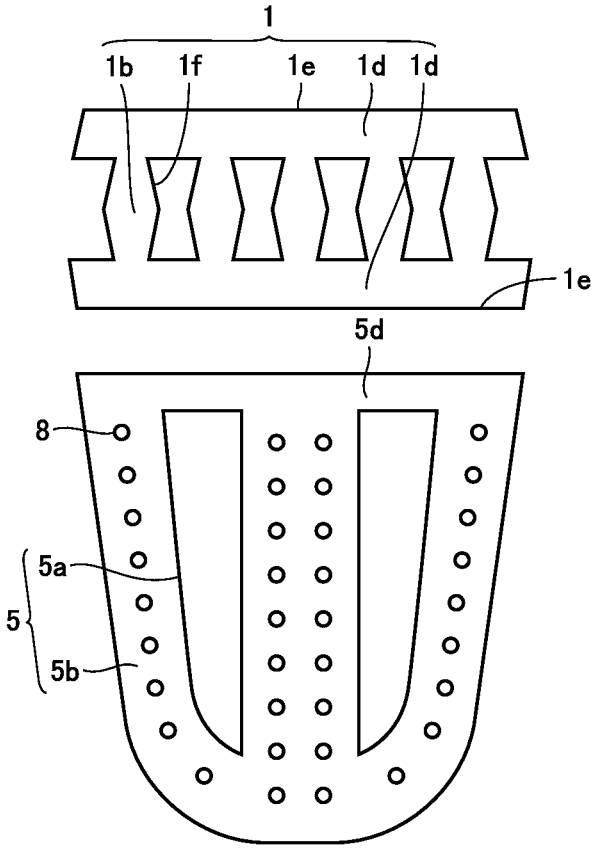
FIG. 14 is a plan view showing the developed state of a member including the second loop and forming the web connection portion in FIGS. 11 and 12.

Referring to FIG. 14, back-side web portion 5b of web portion 5 and web loop 1b of web connection portion 1 are provided separately from each other in the present embodiment. However, in the points other than this, the present embodiment is basically identical to the first embodiment in FIG. 4. Web loop 1b and back-side web portion 5b in the present embodiment are basically identical in shape and size in development view to web loop 1b and back-side web portion 5b in the first embodiment.

Figure 15A:
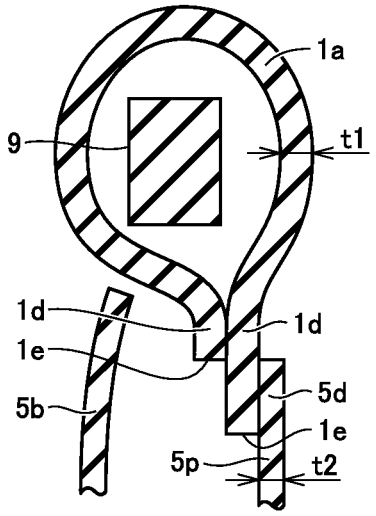
FIG. 15A is a cross-sectional view showing the state of the first web loop provided separately from the web connection portion and the string member passing through the first web loop.

FIG. 15A is a schematic cross-sectional view of a portion, for example, along a line XVA-XVA in FIG. 11. Referring to FIG. 15A, in the structure in which palm-side web portion 5p and web loop 1a in FIG. 13 provided separately from each other are connected to each other, for example, one of a pair of loop sewing portions 1d adjacent to portions located above and below web loop 1a is sewn while being overlapped with a part of web sewing portion 5d of palm-side web portion 5*p*. It is to be noted that a thickness $t_1$ of web loop 1*a* may be different from a thickness $t_2$ of palm-side web portion 5*p*.

Then, for example, one of a pair of loop ends 1*e* in FIG. 13 and loop sewing portion 1*d* near the other loop end 1*e* are sewn while being overlapped with each other, and a pair of loop sewing portions 1*d* are sewn while being overlapped with each other, thereby forming a loop having an annular cross-sectional shape. Loop penetration string 9 passes through this loop. Therefore, FIG. 15A is basically identical in configuration to FIG. 5A except for the point that palm-side web portion 5*p* and loop sewing portion 1*d* are partially overlapped with each other.

Figure 15B:
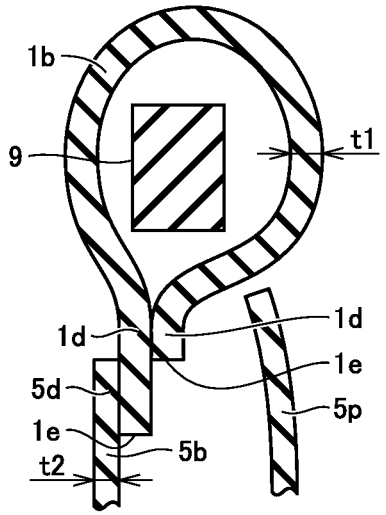
FIG. 15B is a cross-sectional view showing the state of the second web loop provided separately from the web connection portion and the string member passing through the second web loop.

FIG. 15B is a schematic cross-sectional view of a portion, for example, along a line XVB-XVB in FIG. 11. Referring to FIG. 15B, in the structure in which back-side web portion 5*b* and web loop 1*b* in FIG. 14 provided separately from each other are connected to each other, for example, one of a pair of loop sewing portions 1*d* adjacent to portions located above and below web loop 1*b* is sewn so as to be partially overlapped with a part of web sewing portion 5*d* of back-side web portion 5*b*. It is to be noted that thickness $t_1$ of web loop 1*b* may be different from thickness $t_2$ of back-side web portion 5*b*.

Then, for example, one of a pair of loop ends 1*e* in FIG. 14 and loop sewing portion 1*d* near the other loop end 1*e* are sewn while being overlapped with each other, and the pair of loop sewing portions 1*d* are sewn while being overlapped with each other, thereby forming a loop having an annular cross-sectional shape. Loop penetration string 9 passes through this loop. Therefore, FIG. 15B is basically identical in configuration to FIG. 5B except for the point that back-side web portion 5*b* and loop sewing portion 1*d* are partially overlapped with each other.

Figure 16:
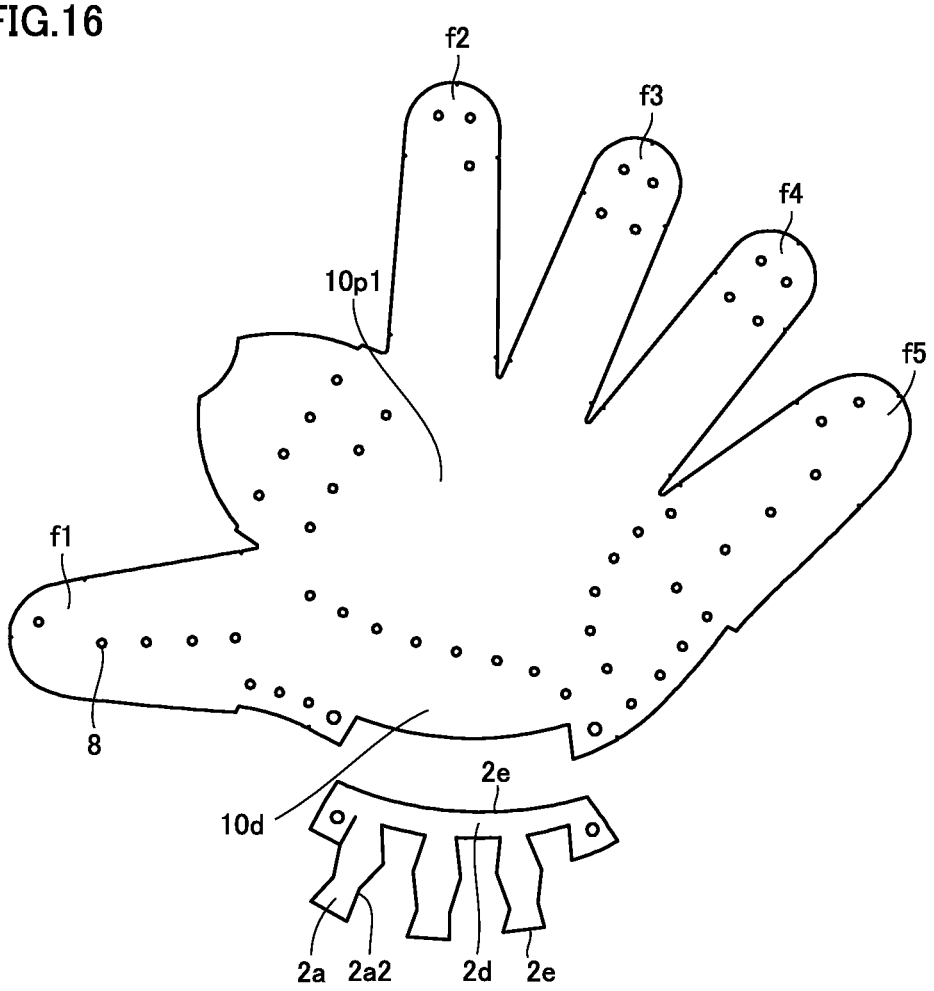
FIG. 16 is a plan view showing the developed state of a member including the first loop and forming a hand insertion connection portion in FIGS. 11 and 12.

Referring to FIG. 16, ball catching plane leather 10*p*1 of palm-side disposed leather 10*p* and hand insertion portion loop 2*a* forming a hand insertion portion are separately provided in the present embodiment. However, in the points other than this, the present embodiment is basically identical to the first embodiment in FIG. 6. Hand insertion portion loop 2*a* and ball catching plane leather 10*p*1 in the present embodiment are basically identical in shape and size in development view to hand insertion portion loop 2*a* and ball catching plane leather 10*p*1 in the first embodiment.

Figure 17:
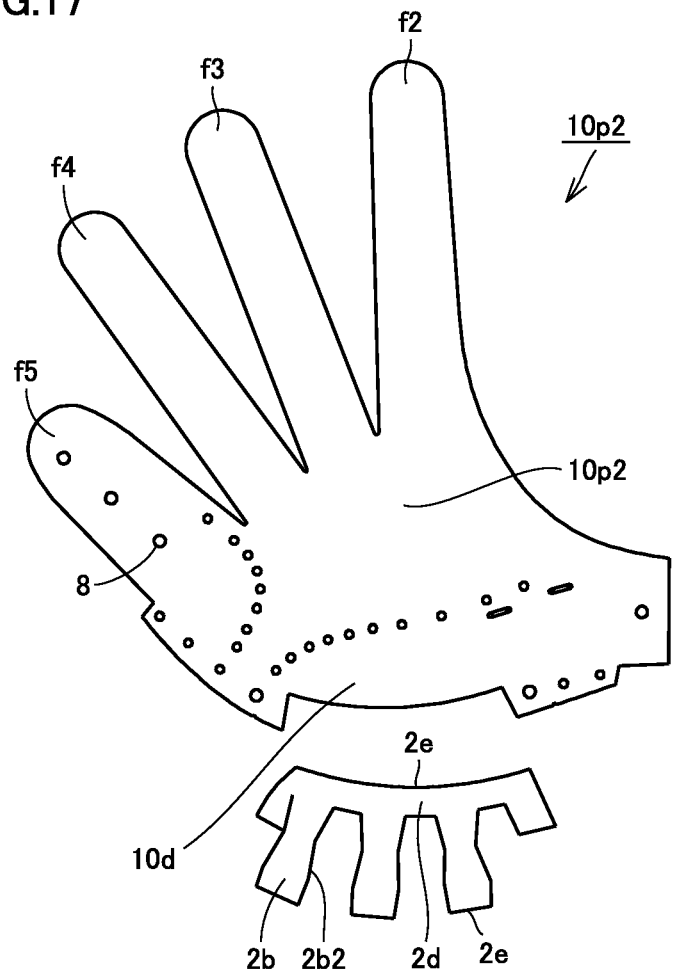
FIG. 17 is a plan view showing the developed state of a member including the second loop and forming the hand insertion connection portion in FIGS. 11 and 12.

Referring to FIG. 17, palm leather 10*p*2 of palm-side disposed leather 10*p* and hand insertion portion loop 2*b* forming a hand insertion portion are separately provided in the present embodiment. However, in the points other than this, the present embodiment is basically identical to the first embodiment in FIG. 7. Hand insertion portion loop 2*b* and palm leather 10*p*2 in the present embodiment are basically identical in shape and size in development view to hand insertion portion loop 2*b* and palm leather 10*p*2 in the first embodiment.

Figure 18A:
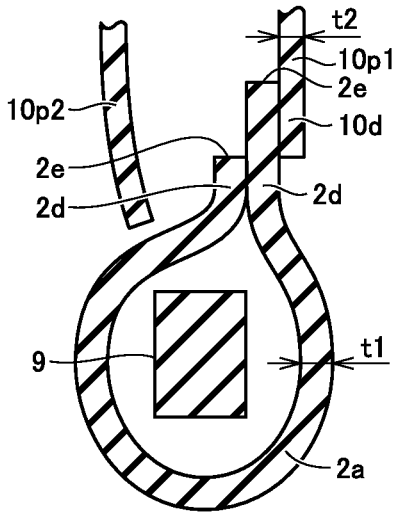
FIG. 18A is a cross-sectional view showing the state of the first hand insertion portion loop provided separately from the ball catching plane leather and the string member passing through the first hand insertion portion loop.

FIG. 18A is a schematic cross-sectional view of a portion, for example, along a line XVIIIA-XVIIIA in FIG. 11. Referring to FIG. 18A, in the structure in which ball catching plane leather 10*p*1 and hand insertion portion loop 2*a* in FIG. 16 provided separately from each other are connected to each other, for example, loop sewing portion 2*d* located adjacent to hand insertion portion loop 2*a* is sewn while being overlapped with ball catching plane sewing portion 10*d* of ball catching plane leather 10*p*1. In addition, it is preferable that thickness $t_1$ of hand insertion portion loop 2*a* is greater than thickness $t_2$ of ball catching plane leather 10*p*1.

For example, one of a pair of loop ends 2*e* in FIG. 16 (loop end 2*e* in a lower area in FIG. 16 that corresponds to a tip end portion of hand insertion portion loop 2*a*) is sewn to ball catching plane sewing portion 10*d* near the other loop end 2*e* (so as to be overlapped with a loop sewing portion), thereby forming a loop having an annular cross-sectional shape. Then, loop penetration string 9 passes through this loop. Therefore, FIG. 18A is basically identical in configuration to FIG. 8A except for the point that ball catching plane leather 10*p*1 and loop sewing portion 2*d* are partially overlapped with each other.

Figure 18B:
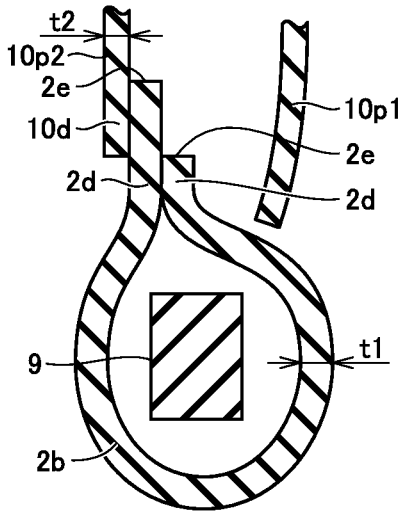
FIG. 18B is a cross-sectional view showing the state of the second hand insertion portion loop provided separately from the palm leather and the string member passing through the second hand insertion portion loop.

FIG. 18B is a schematic cross-sectional view of a portion, for example, along a line XVIIIB-XVIIIB in FIG. 11. Referring to FIG. 18B, in the structure in which palm leather 10*p*2 and hand insertion portion loop 2*b* in FIG. 17 provided separately from each other are connected to each other, for example, loop sewing portion 2*d* located adjacent to hand insertion portion loop 2*b* is sewn to ball catching plane sewing portion 10*d* of palm leather 10*p*2 while being overlapped with each other. It is preferable that thickness $t_1$ of hand insertion portion loop 2*b* is greater than thickness $t_2$ of palm leather 10*p*2.

Then, for example, one of a pair of loop ends 2*e* in FIG. 17 (loop end 2*e* in a lower area in FIG. 16 that corresponds to a tip end portion of hand insertion portion loop 2*b*) is sewn to ball catching plane sewing portion 10*d* near the other loop end 2*e* (so as to be overlapped with the loop sewing portion), thereby forming a loop having an annular cross-sectional shape. Loop penetration string 9 passes through this loop. Therefore, FIG. 18B is basically identical in configuration to FIG. 8B except for the point that palm leather 10*p*2 and loop sewing portion 2*d* are partially overlapped with each other.

Since the configuration of the present embodiment other than the above is almost the same as the configuration of the first embodiment shown in FIGS. 1 and 2, the same components are designated by the same reference characters, and the description thereof will not be repeated.

Then, the functions and effects of the present embodiment will be described.

In the present embodiment, in addition to the functions and effects of the first embodiment, the first loop is provided separately from the first leather member while the second loop is provided separately from the second leather member, as shown in FIGS. 13, 14, 16, and 17. Accordingly, as shown in FIGS. 18A and 18B, the first loop can be formed so as to have a thickness different from the thickness of the first leather member, and the second loop can be formed so as to have a thickness different from the thickness of the second leather member. For example, if the (first or second) loop is formed so as to be thicker than the (first or second) leather member, the durability of the corresponding portion is improved. On the other hand, for example, if the (first or second) loop is formed so as to be thinner than the (first or second) leather member, the corresponding portion can be readily bent.

(Third Embodiment)

Figure 19:
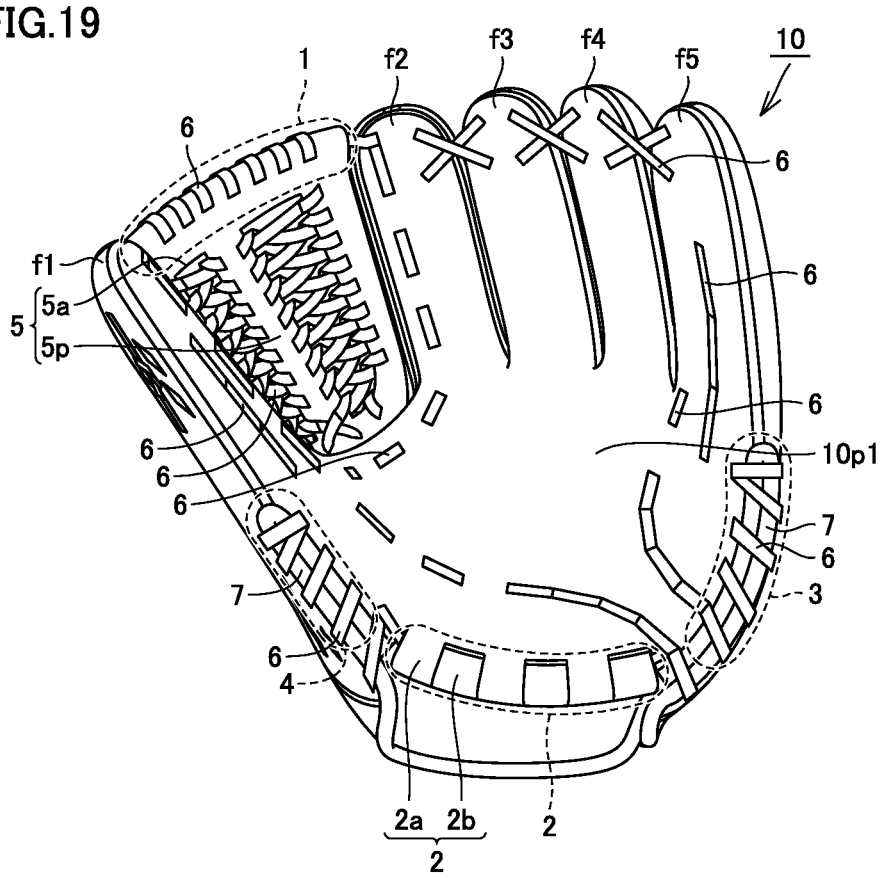
FIG. 19 is a schematic diagram showing the configuration of a region including a ball catching plane leather disposed on the palm side of the user's hand according to a ball catching tool of the third embodiment.
Figure 20:
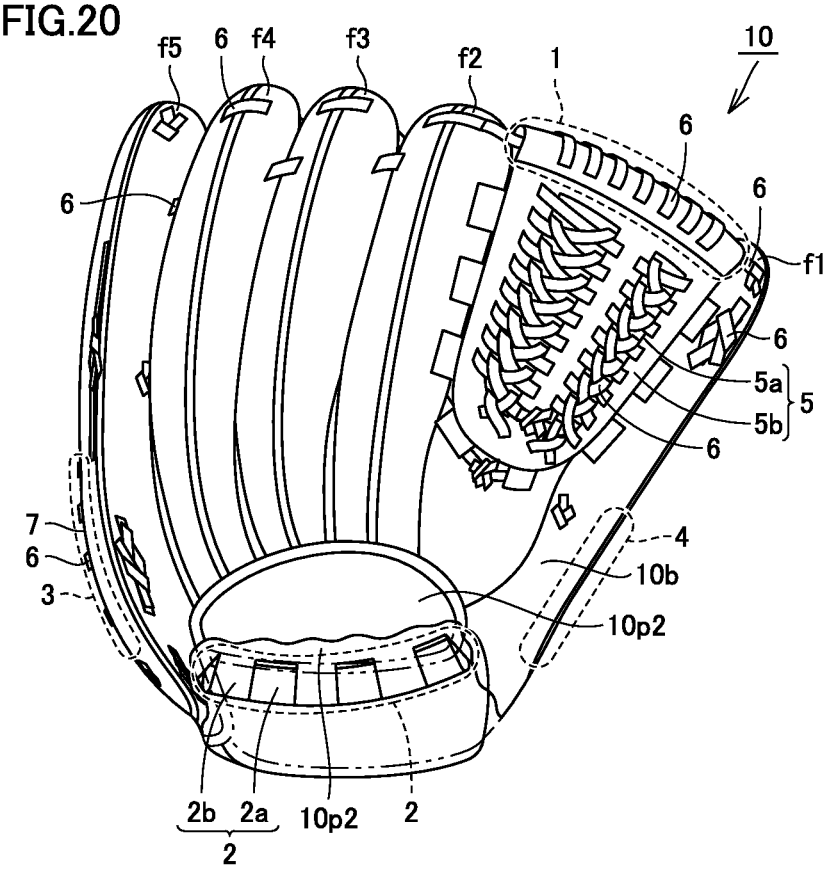
FIG. 20 is a schematic diagram showing the configuration of a region including a back leather disposed on the back side of the user's hand according to the ball catching tool of the third embodiment.

Referring to FIGS. 19 and 20, glove 10 of the present embodiment is different in configuration of web connection portion 1 as compared with the configuration of the first embodiment shown in FIGS. 1 and 2 (in which the leather member and the loop are integrated with each other). Specifically, palm-side web portion 5*p* and back-side web portion 5*b* are not connected at web connection portion 1 by web loops 1*a* and 1*b*, but thin leather string 6 is caused to pass through holes (not shown) provided at regular intervals in the upper end portion obtained by folding back one sheet of leather. This thin leather string 6 is spirally wound between these holes and the outer surface of the upper end portion. In other words, only hand insertion connection portion 2 is connected by hand insertion portion loops 2*a* and 2*b* in the present embodiment. Such a configuration may be provided.

(Fourth Embodiment)

Figure 21:
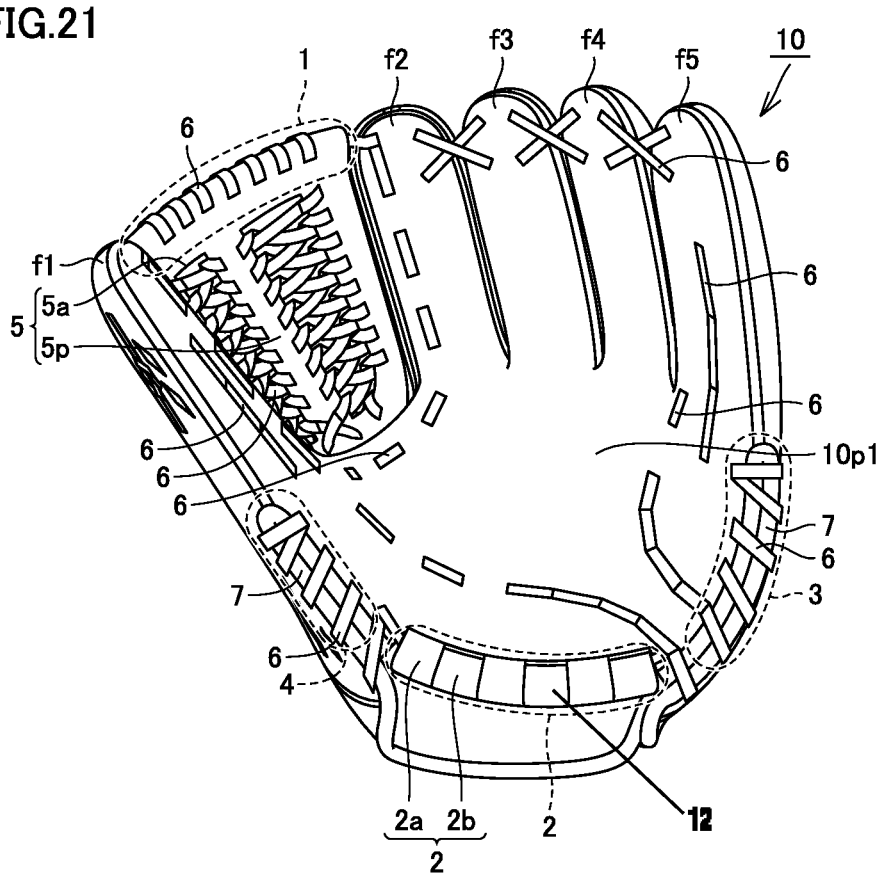
FIG. 21 is a schematic diagram showing the configuration of a region including a ball catching plane leather disposed on the palm side of the user's hand according to a ball catching tool of the fourth embodiment.
Figure 22:
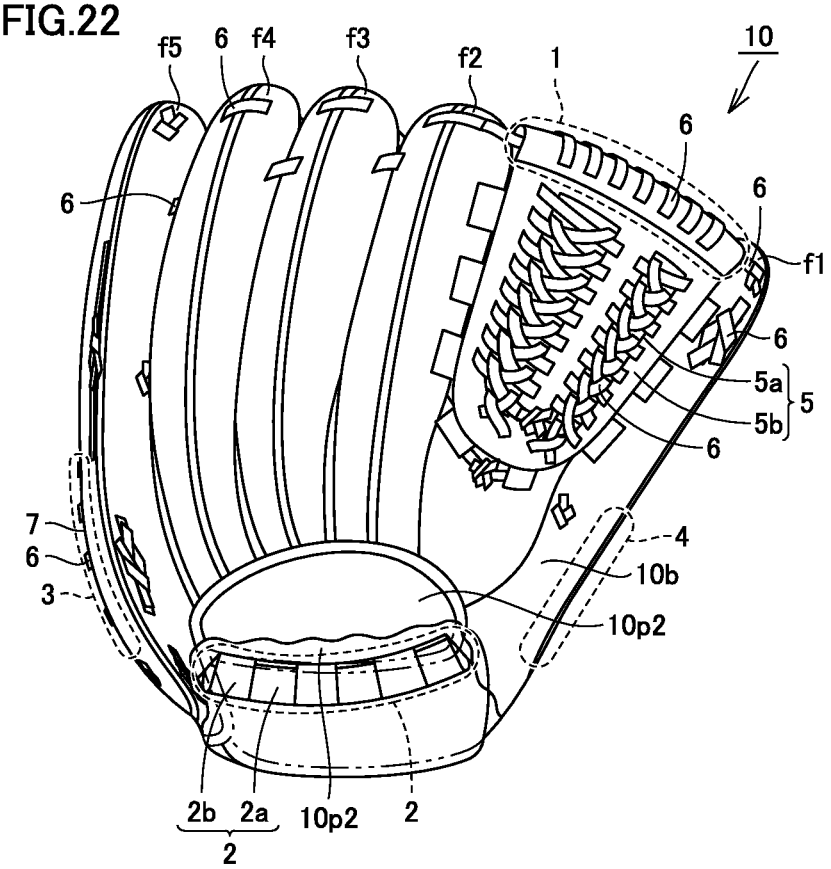
FIG. 22 is a schematic diagram showing the configuration of a region including a back leather disposed on the back side of the user's hand according to the ball catching tool of the fourth embodiment.

Referring to FIGS. 21 and 22, glove 10 of the present embodiment is different in configuration of web connection portion 1 as compared with the configuration of the second embodiment shown in FIGS. 11 and 12 (in which the leather member and the loop are separately provided). Specifically, palm-side web portion 5*p* and back-side web portion 5*b* are not connected at web connection portion 1 by web loops 1*a* and 1*b*, but thin leather string 6 is caused to pass through holes (not shown) provided at regular intervals in the upper end portion obtained by folding back one sheet of leather. This thin leather string 6 is spirally wound between these holes and the outer surface of the upper end portion. In other words, the connection manner of web connection portion 1 in this case is similar to that in the third embodiment, in which only hand insertion connection portion 2 is connected by hand insertion portion loops 2*a* and 2*b*, and located in the heel portion 12 of glove 10. Such a configuration may be provided.

(Fifth Embodiment)

Figure 23:
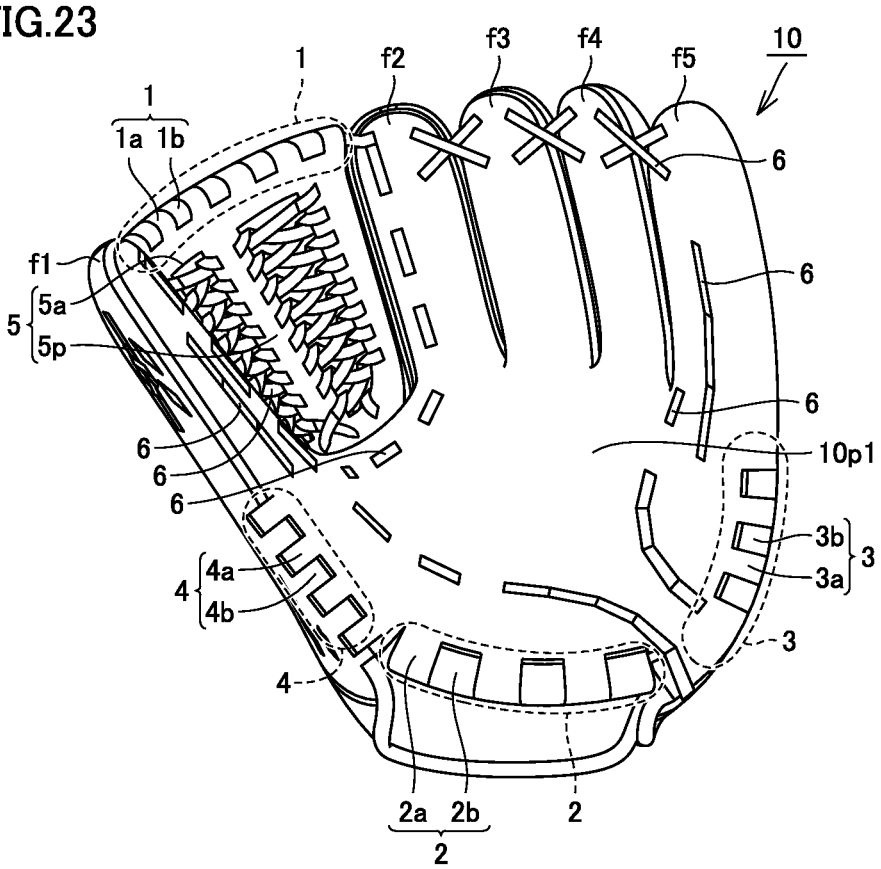
FIG. 23 is a schematic diagram showing the configuration of a region including a ball catching plane leather disposed on the palm side of the user's hand according to a ball catching tool of the fifth embodiment.
Figure 24:
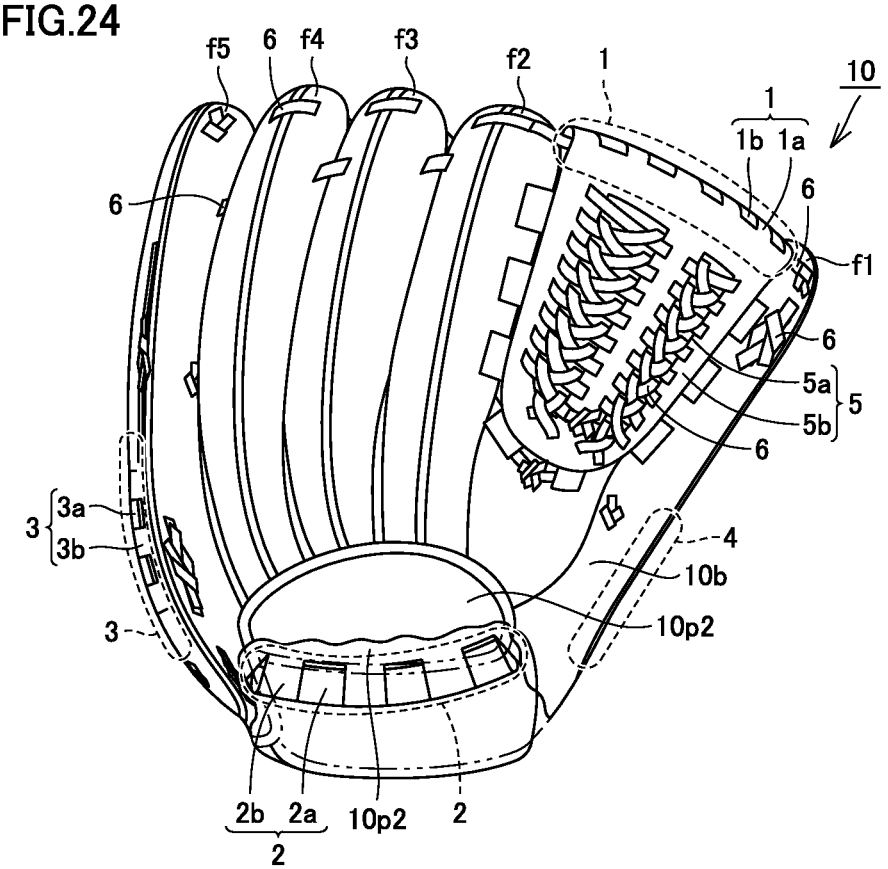
FIG. 24 is a schematic diagram showing the configuration of a region including a back leather disposed on the back side of the user's hand according to the ball catching tool of the fifth embodiment.

Referring to FIGS. 23 and 24, glove 10 of the present embodiment is different in configuration of wrist adjoining connection portions 3 and 4 as compared with the configuration of the first embodiment shown in FIGS. 1 and 2 (in which the leather member and the loop are integrated with each other). Specifically, in wrist adjoining connection portion 3, similarly to web connection portion 1 and hand insertion connection portion 2, palm-side disposed leather 10*p* (the first leather member) and back leather 10*b* (the second leather member) are connected by a wrist adjoining portion loop 3*a* (the first loop) and a wrist adjoining portion loop 3*b* (the second loop) and also by a loop penetration string (not shown) that passes through these loops. Furthermore, also in wrist adjoining connection portion 4, similarly to web connection portion 1 and hand insertion connection portion 2, palm-side disposed leather 10*p* and back leather 10*b* are connected by wrist adjoining portion loops 4*a* and 4*b* and also by a loop penetration string (not shown) that passes through these loops.

In the present embodiment, palm-side disposed leather 10*p* and wrist adjoining portion loop 3*a* are integrally formed while back leather 10*b* and wrist adjoining portion loop 3*b* are integrally formed. Also in the present embodiment, palm-side disposed leather 10*p* and wrist adjoining portion loop 4*a* are integrally formed while back leather 10*b* and wrist adjoining portion loop 4*b* are integrally formed.

Therefore, wrist adjoining portion loops 3*a*, 3*b* in wrist adjoining connection portion 3 and wrist adjoining portion loops 4*a*, 4*b* in wrist adjoining connection portion 4 are basically similar in cross section to loops 1*a* and 1*b* of web connection portion 1 shown in FIGS. 5A and 5B. However, since palm-side disposed leather 10*p* formed integrally with wrist adjoining portion loops 3*a* and 4*a* has a configuration in which ball catching plane leather 10*p*1 and palm leather 10*p*2 are overlapped with each other, palm-side disposed leather 10*p* equivalent to palm-side web portion 5*p* in FIG. 5A is to have a total of three layers including ball catching plane leather 10*p*1, palm leather 10*p*2, and back leather 10*b*.

In this way, the fixing portion implemented by loops may be configured to fix a total of three layers. Also in this case, a loop is formed from each piece of leather of these three layers, and a string passes through these loops, so that these loops are connected to each other.

Since the configuration of the present embodiment other than the above is almost the same as the configuration of the first embodiment shown in FIGS. 1 and 2, the same components are designated by the same reference characters, and the description thereof will not be repeated.

Then, the functions and effects of the present embodiment will be described.

According to the present embodiment, in addition to web connection portion 1 and hand insertion connection portion 2, wrist adjoining portion loops 3*a*, 3*b* and 4*a*, 4*b* are used for connection in wrist adjoining connection portions 3 and 4, respectively. Accordingly, as compared with the case where wrist adjoining connection portions 3 and 4 are connected by a normal leather string 6 or the like as in the first embodiment, wrist adjoining connection portions 3 and 4 can be readily bent, and thus, can be caused to readily follow the movement of the user's hand. Therefore, glove 10 can be bent with relatively smaller force, so that the ball catching action can be more readily carried out.

(Sixth Embodiment)

Figure 25:
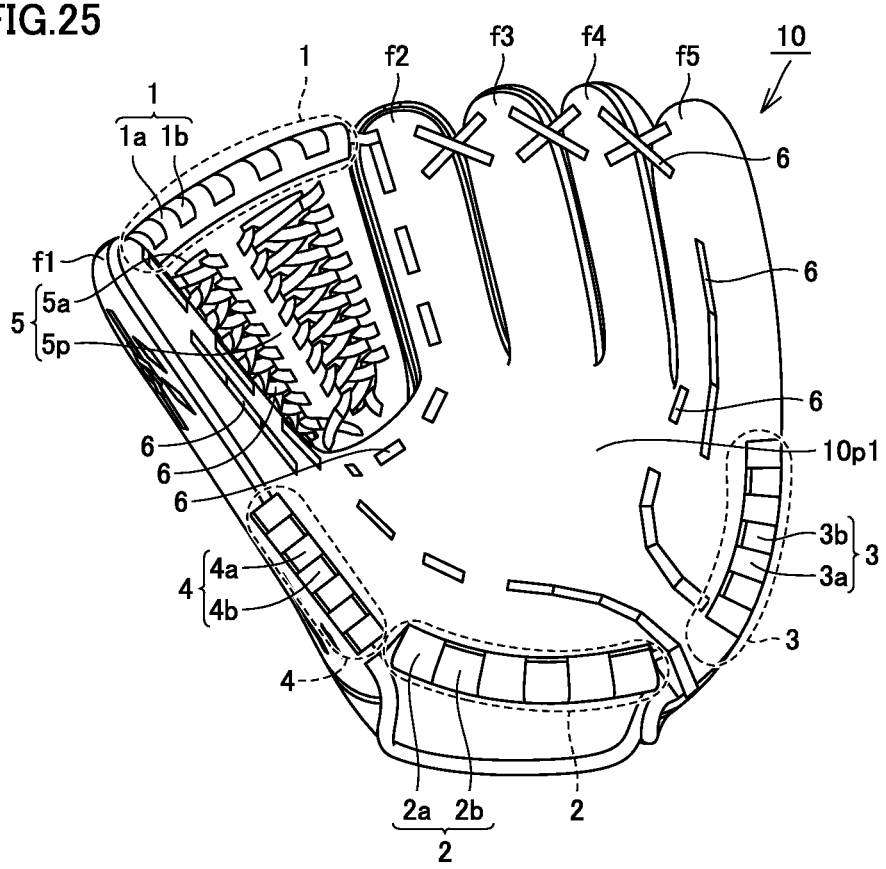
FIG. 25 is a schematic diagram showing the configuration of a region including a ball catching plane leather disposed on the palm side of the user's hand according to a ball catching tool of the sixth embodiment.
Figure 26:
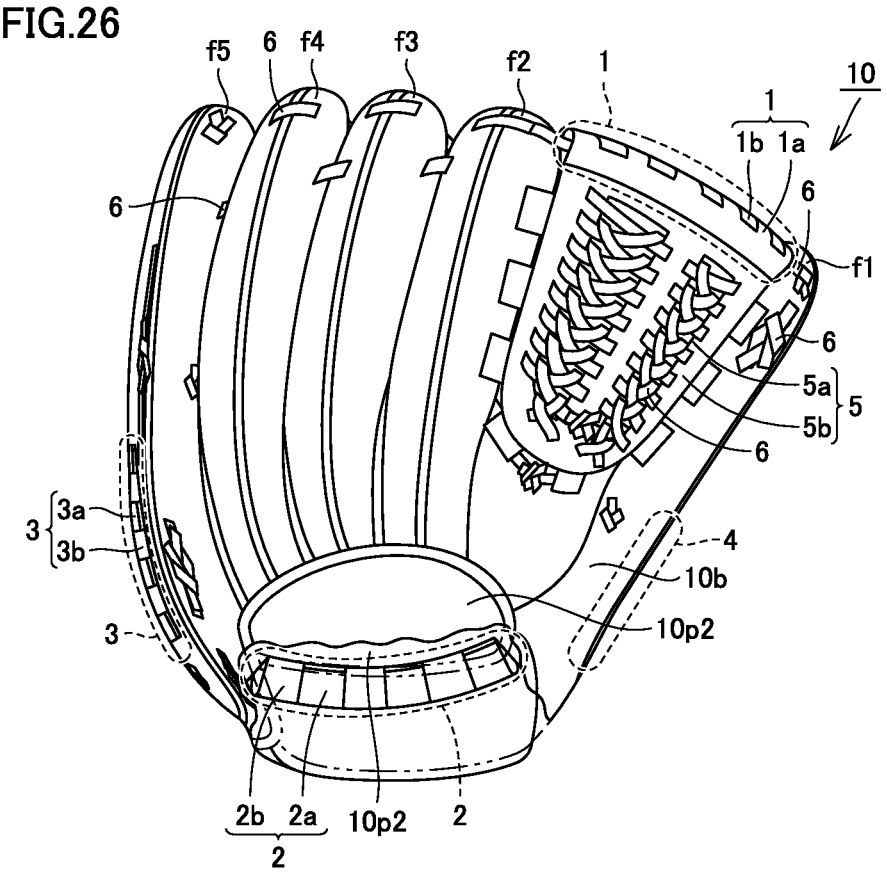
FIG. 26 is a schematic diagram showing the configuration of a region including a back leather disposed on the back side of the user's hand according to the ball catching tool of the sixth embodiment.

Referring to FIGS. 25 and 26, as compared with the configuration of the fifth embodiment shown in FIGS. 23 and 24 (in which a leather member and a loop are integrally formed), glove 10 in the present embodiment is different in the point that a leather member and a loop are separately provided in each of connection portions 1, 2, 3, and 4 including wrist adjoining connection portions 3 and 4.

Web connection portion 1 and hand insertion connection portion 2 are configured in the manner similar to those of glove 10 in the second embodiment. Also, as to wrist adjoining connection portions 3 and 4, palm-side disposed leather 10*p* is provided separately from wrist adjoining portion loops 3*a* and 4*a* while back leather 10*b* is provided separately from wrist adjoining portion loops 3*b* and 4*b*.

Therefore, wrist adjoining portion loops 3*a* and 3*b* in wrist adjoining connection portion 3 and wrist adjoining portion loops 4*a* and 4*b* in wrist adjoining connection portion 4 are basically similar in cross section to loops 1*a* and 1*b* of web connection portion 1 shown in FIGS. 15A and 15B. However, since palm-side disposed leather 10*p* formed integrally with wrist adjoining portion loops 3*a* and 4*a* has a configuration in which ball catching plane leather 10*p*1 and palm leather 10*p*2 are overlapped with each other, palm-side disposed leather 10*p* equivalent to palm-side web portion 5*p* in FIG. 15A is to have a total of two layers including ball catching plane leather 10*p*1 and palm leather 10*p*2.

Since the configuration of the present embodiment other than the above is almost the same as that of the first embodiment shown in FIGS. 1 and 2, the same components are designated by the same reference characters, and the description thereof will not be repeated.

Also in the present embodiment, wrist adjoining connection portions 3 and 4 are connected by loops as in the fifth embodiment, and therefore, can be readily bent. Furthermore, as in the second embodiment, a leather member and a loop are formed separately from each other in each of connection portions 1 to 4. Accordingly, for example, the loop is formed so as to be thicker than the leather member, thereby allowing improvement in the strength of each connection portion.

(Seventh Embodiment)

Figure 27:
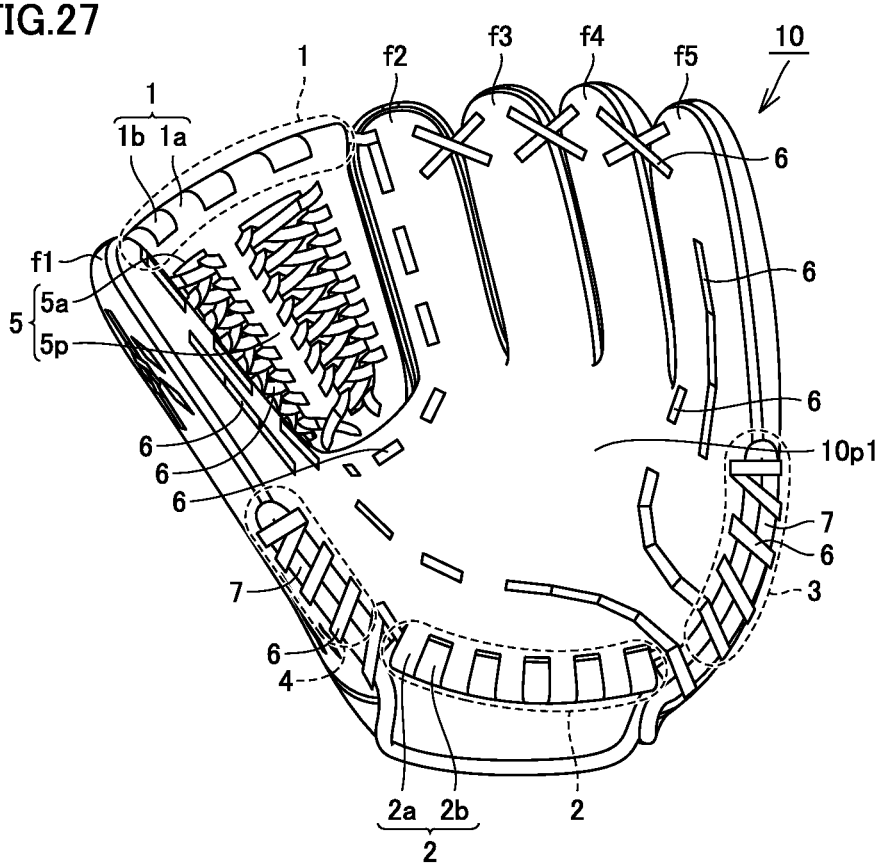
FIG. 27 is a schematic diagram showing the configuration of a region including a ball catching plane leather disposed on the palm side of the user's hand according to a ball catching tool of the seventh embodiment.
Figure 28:
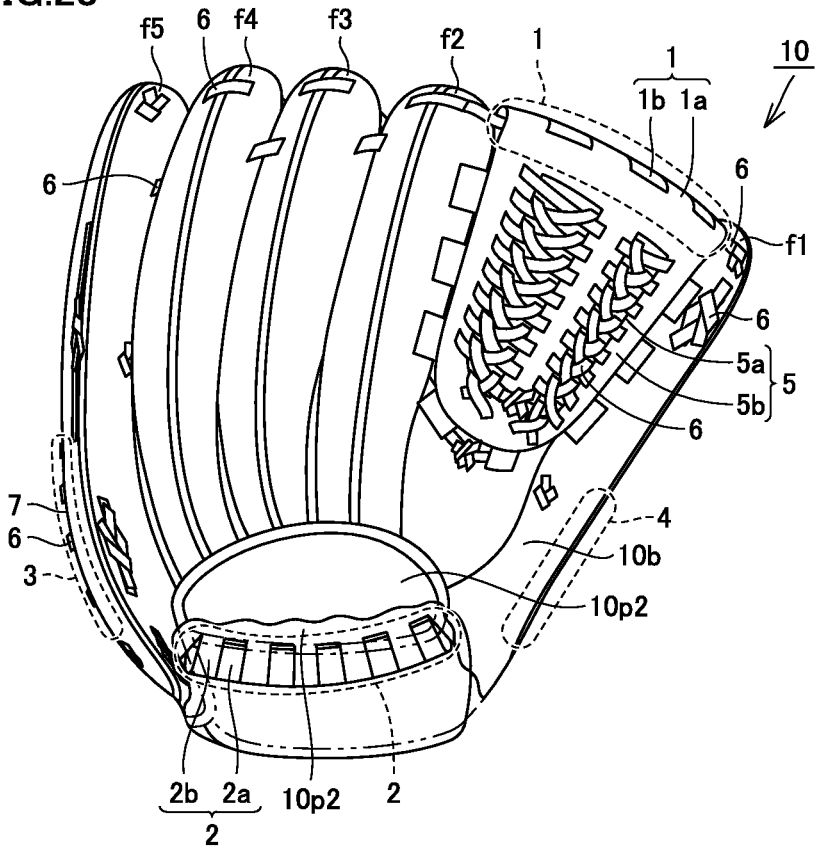
FIG. 28 is a schematic diagram showing the configuration of a region including a back leather disposed on the back side of the user's hand according to the ball catching tool of the seventh embodiment.

Referring to FIGS. 27 and 28, as compared with the configuration of the first embodiment shown in FIGS. 1 and 2, glove 10 in the present embodiment is different in number of pitches of web loops 1*b* in web connection portion 1 and also different in number of pitches of hand insertion portion loops 2*b* in hand insertion connection portion 2. Specifically, in the present embodiment, three pitches of web loops 1*b* and five pitches of hand insertion portion loops 2*b* are arranged.

The number of loop pitches may be arbitrarily changed as in the present embodiment. The more the number of pitches is increased, the shorter the distance between the loops adjacent to each other in the same loop portion is, with the result that the connection portion can be further readily bent. Specifically, when web connection portion 1 has three pitches of web loops 1*b* and hand insertion connection portion 2 has five pitches of hand insertion portion loops 2*b* as in the second embodiment, hand insertion connection portion 2 can be improved particularly in flexibility, thereby allowing hand insertion connection portion 2 to be readily bent, for example, as compared with the case where web connection portion 1 has five pitches of web loops 1*b* and hand insertion connection portion 2 has three pitches of hand insertion portion loops 2*b* as in the first embodiment.

(Eighth Embodiment)

Figure 29:
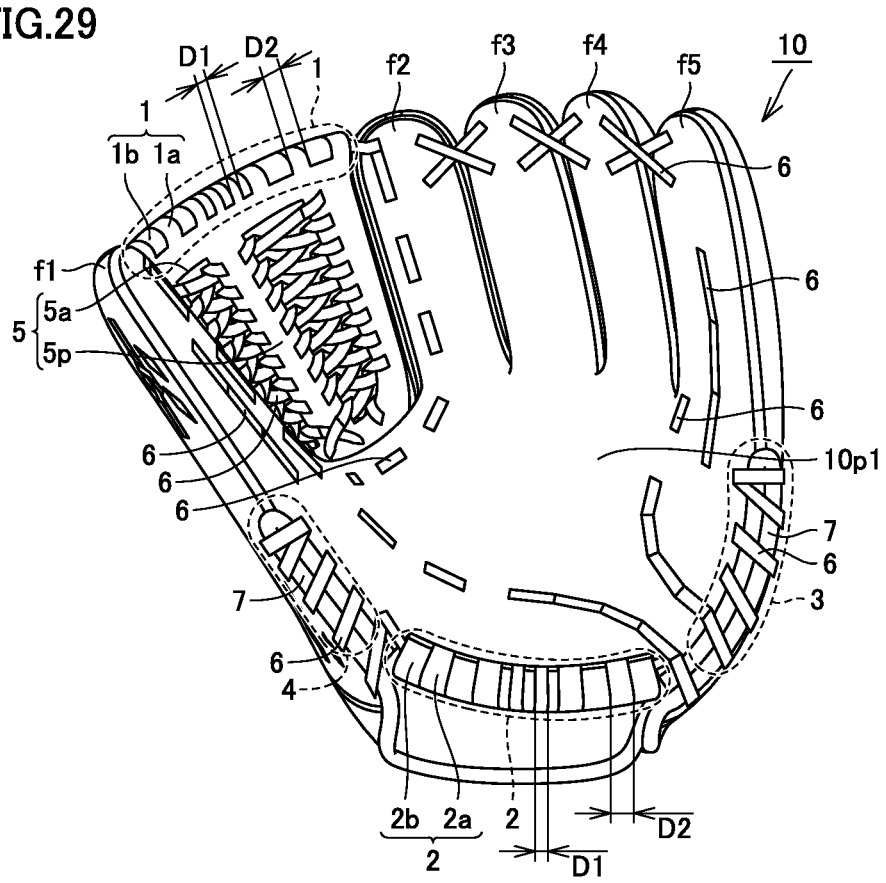
FIG. 29 is a schematic diagram showing the configuration of a region including a ball catching plane leather disposed on the palm side of the user's hand according to a ball catching tool of the eighth embodiment.
Figure 30:
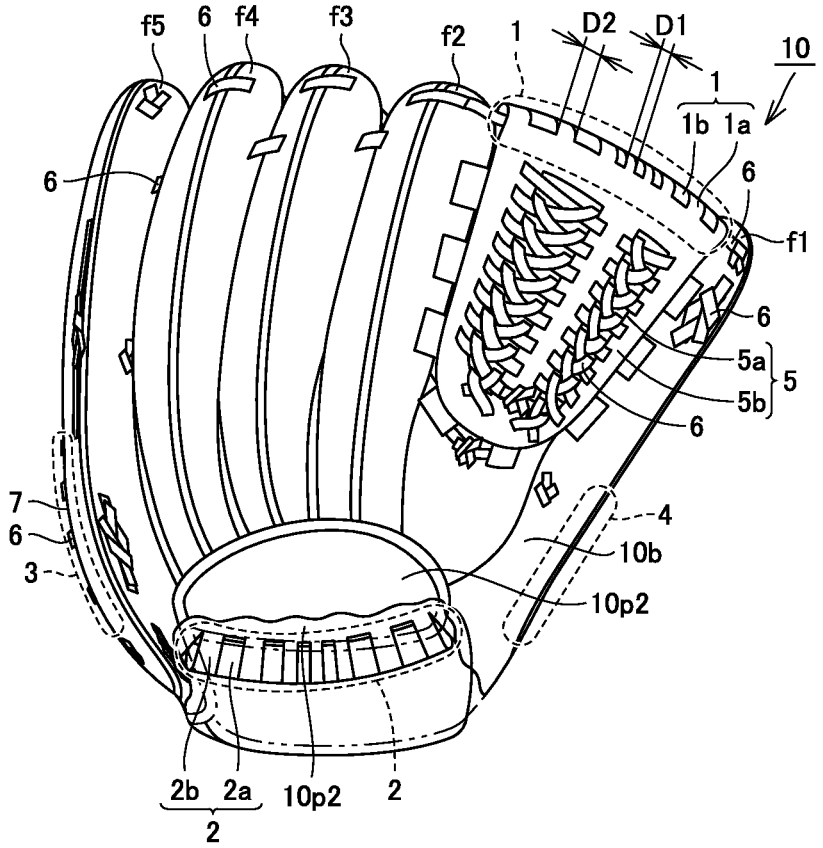
FIG. 30 is a schematic diagram showing the configuration of a region including a back leather disposed on the back side of the user's hand according to the ball catching tool of the eighth embodiment.

Referring to FIGS. 29 and 30, as compared with the configuration of the first embodiment shown in FIGS. 1 and 2, glove 10 of the present embodiment is different in number of pitches of web loops 1*b* in web connection portion 1 and in number of pitches of hand insertion portion loops 2*b* in hand insertion connection portion 2, and also in the distance (pitch) between the loops adjacent to each other in the same loop portion.

In each of the embodiments described above, the distances (pitches) between the loops adjacent to each other in the same loop portion are basically almost the same in each of connection portions 1 to 4. In the present embodiment, however, the pitch between the loops adjacent to each other in the same loop portion is changed depending on positions. Particularly in the present embodiment, each pitch in the center portion with respect to the horizontal direction of the figure in which connection portions 1 and 2 extend is shorter than each pitch located at end portions. Accordingly, a distance D1 is shorter than a distance D2 as shown in FIGS. 29 and 30. Furthermore, as to the number of pitches, web connection portion 1 and hand insertion connection portion 2 each exhibit seven pitches.

In each of connection portions 1 and 2, when the pitches in the extending direction of these connection portions 1 and 2, that is, in the horizontal direction in FIG. 29, are relatively short, the corresponding portions are improved in flexibility, and therefore, can be readily bent. In particular, when each pitch in the center portion of each of connection portions 1 and 2 is shortened, connection portions 1 and 2 can be further readily bent.

(Ninth Embodiment)

Figure 31:
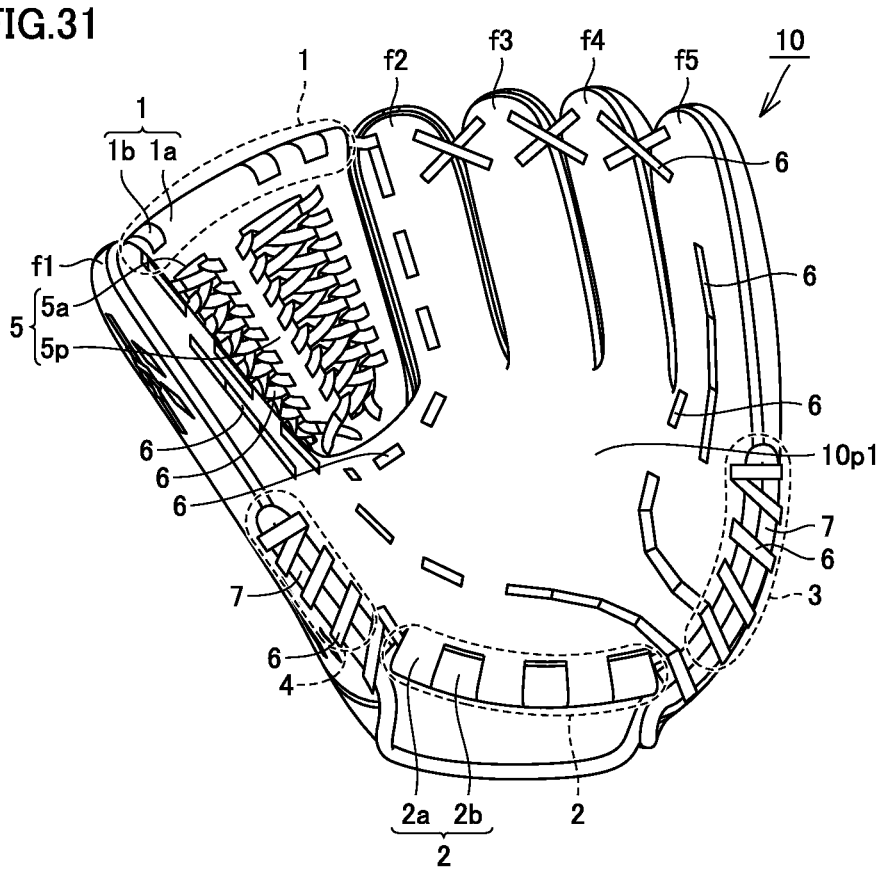
FIG. 31 is a schematic diagram showing the configuration of a region including a ball catching plane leather disposed on the palm side of the user's hand according to a ball catching tool of the ninth embodiment.
Figure 32:
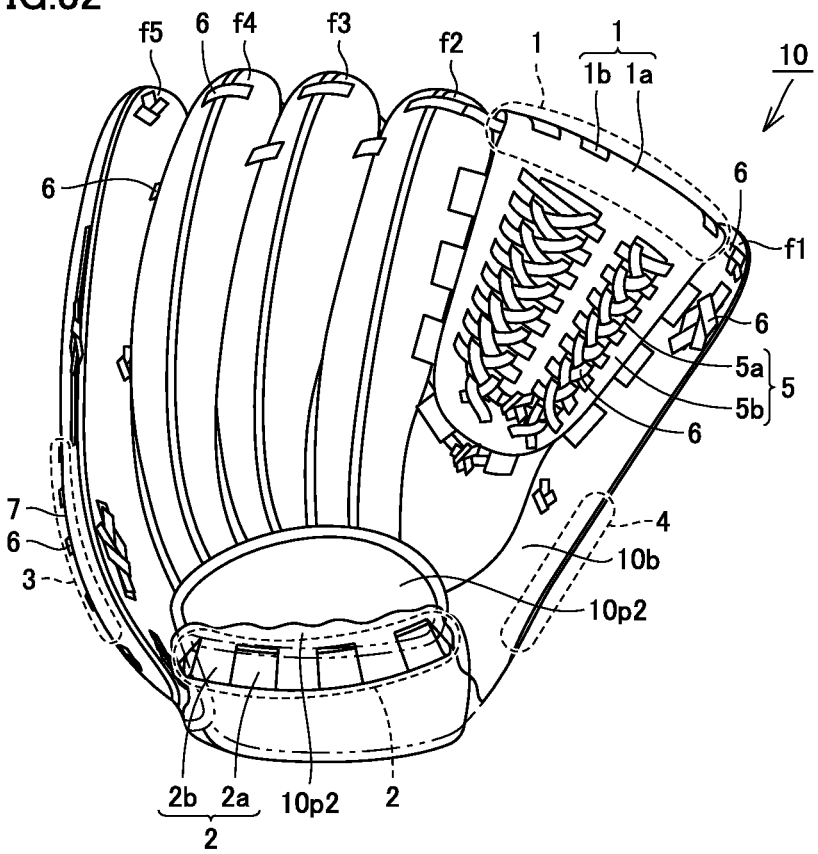
FIG. 32 is a schematic diagram showing the configuration of a region including a back leather disposed on the back side of the user's hand according to the ball catching tool of the ninth embodiment.

Referring to FIGS. 31 and 32 showing another modification other than each of the embodiments described above, in glove 10, for example, each of web connection portion 1 and hand insertion connection portion 2 may have three pitches of loops and each pitch of web loop 1*b* in the center portion in the extending direction of web connection portion 1 may be longer than that in other regions.

(Tenth Embodiment)

Figure 33:
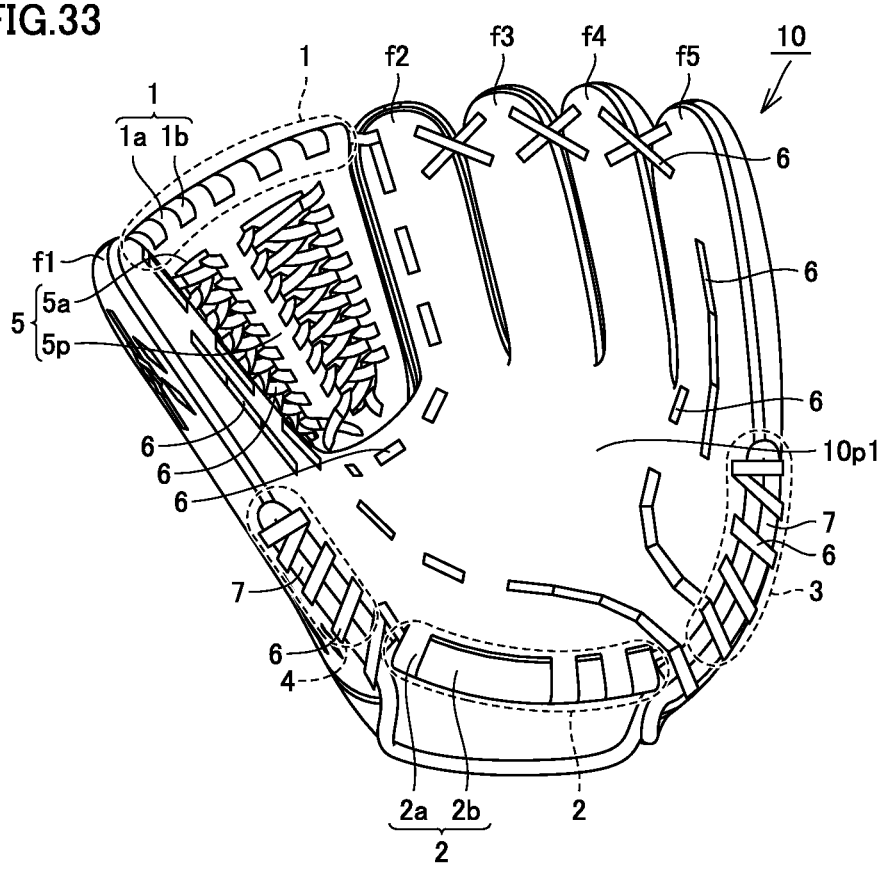
FIG. 33 is a schematic diagram showing the configuration of a region including a ball catching plane leather disposed on the palm side of the user's hand according to a ball catching tool of the tenth embodiment.
Figure 34:
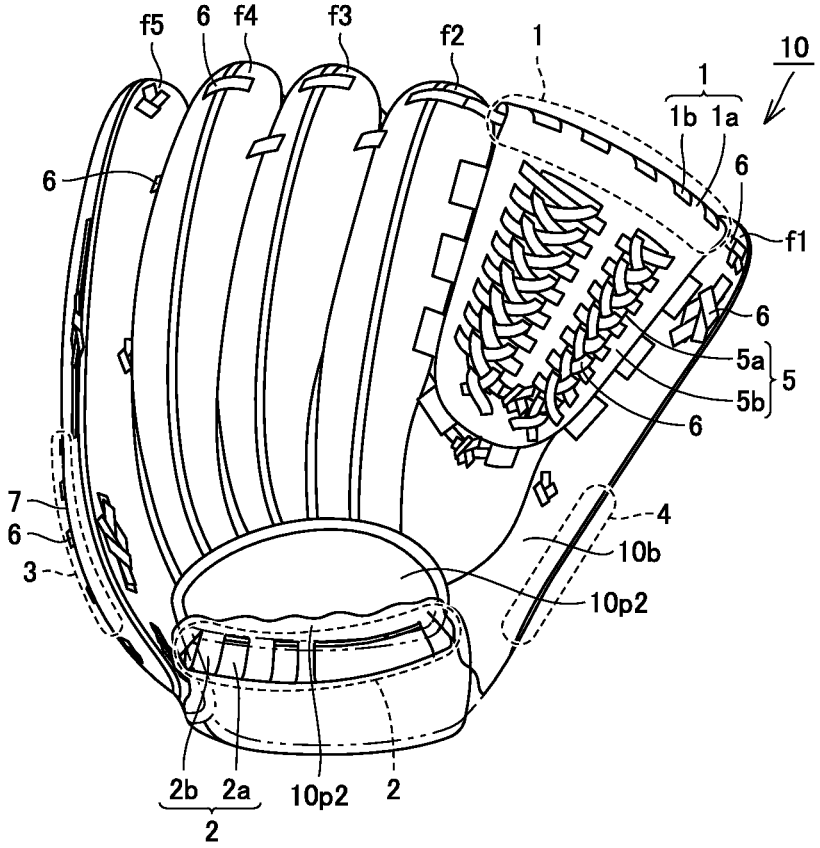
FIG. 34 is a schematic diagram showing the configuration of a region including a back leather disposed on the back side of the user's hand according to the ball catching tool of the tenth embodiment.

Referring to FIGS. 33 and 34 showing a still another modification, in glove 10, for example, web connection portion 1 may have five pitches of loops; hand insertion connection portion 2 may have three pitches of loops; and each hand insertion portion loop 2*b* in the center portion with respect to the extending direction of hand insertion connection portion 2 may be longer than other hand insertion portion loops 2*b*.

(Eleventh Embodiment)

Figure 35:
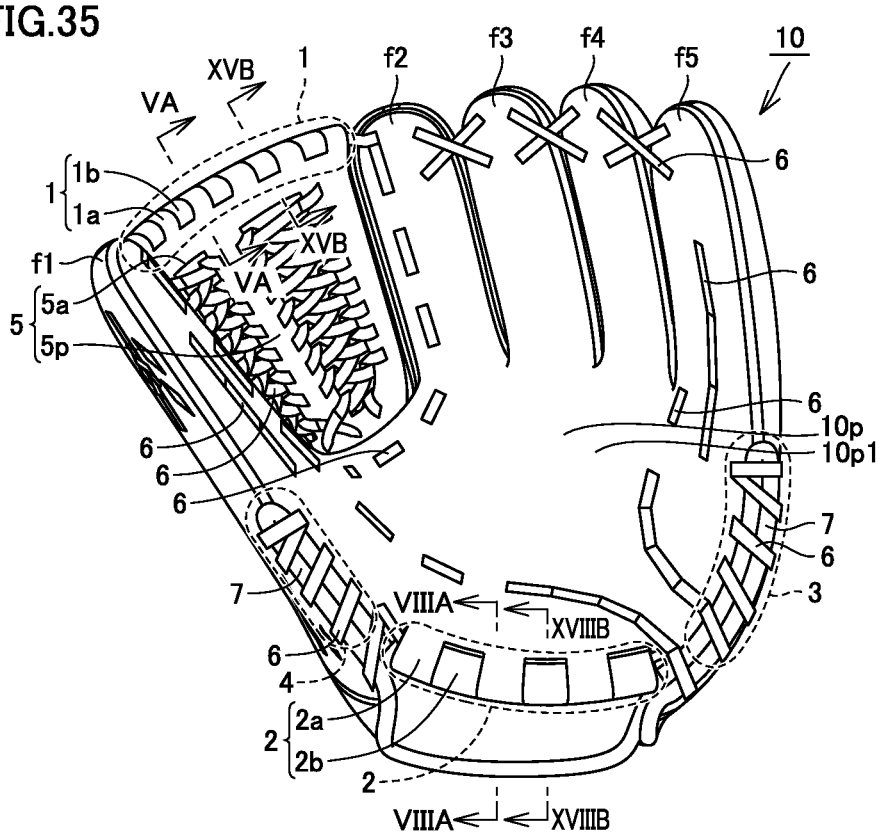
FIG. 35 is a schematic diagram showing the configuration of a region including a ball catching plane leather disposed on the palm side of the user's hand according to a ball catching tool in the first example of the eleventh embodiment.

Referring to FIG. 35 showing a still another modification, web loop 1*a* and palm-side web portion 5*p* are integrally provided as shown in FIG. 5A (showing the portion along a line VA-VA) while web loop 1*b* and back-side web portion 5*b* may be separately provided as shown in FIG. 15B (showing the portion along a line XVB-XVB). Similarly, hand insertion portion loop 2*a* and ball catching plane leather 10*p*1 are integrally provided as shown in FIG. 8A (showing the portion along a line VIIIA-VIIIA) while hand insertion portion loop 2*b* and palm leather 10*p*2 may be separately provided as shown in FIG. 18B (showing the portion along a line XVIIIB-XVIIIB). In this way, the first loop may be provided integrally with the first leather member while the second loop may be provided separately from the second leather member.

Figure 36:
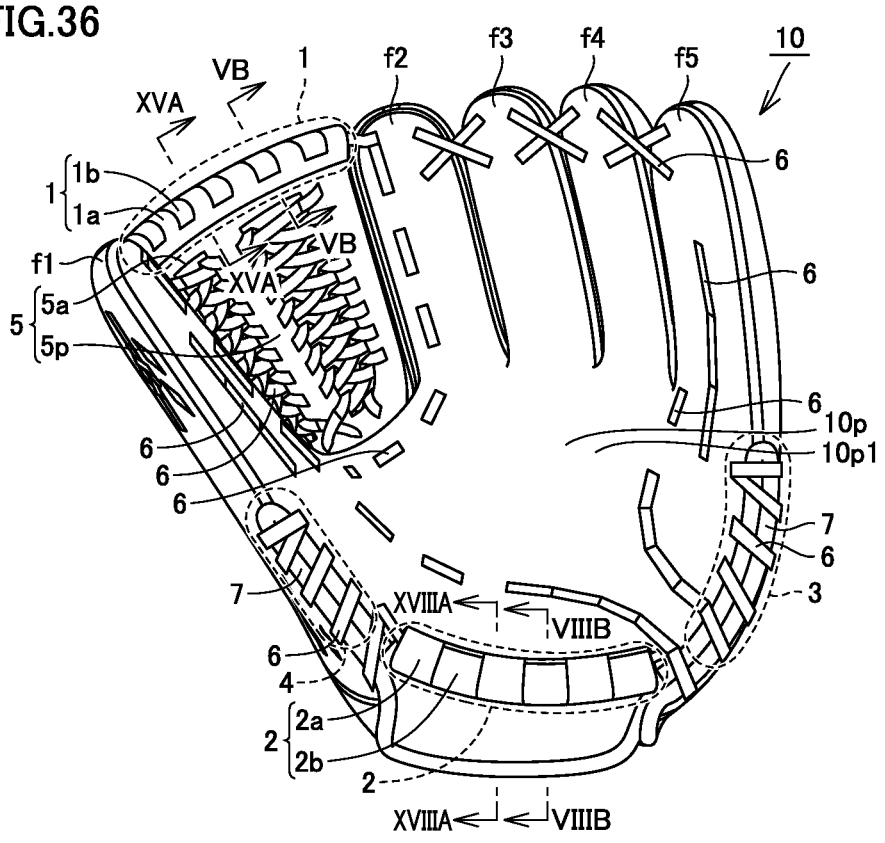
FIG. 36 is a schematic diagram showing the configuration of a region including a ball catching plane leather disposed on the palm side of the user's hand according to a ball catching tool in the second example of the eleventh embodiment.

Also referring to FIG. 36, web loop 1*a* and palm-side web portion 5*p* are provided separately from each other as shown in FIG. 15A (showing the portion along a line XVA-XVA), but web loop 1*b* and back-side web portion 5*b* may be integrally provided as shown in FIG. 5B (showing the portion along a line VB-VB). Similarly, hand insertion portion loop 2*a* and ball catching plane leather 10*p*1 are separately provided as shown in FIG. 18A (showing the portion along a line XVIIIA-XVIIIA), but hand insertion portion loop 2*b* and palm leather 10*p*2 may be integrally provided as shown in FIG. 8B (showing the portion along a line VIIIB-VIIIB). In this way, the first loop may be provided separately from the first leather member while the second loop may be provided integrally with the second leather member.

(Twelfth Embodiment)

Figure 37:
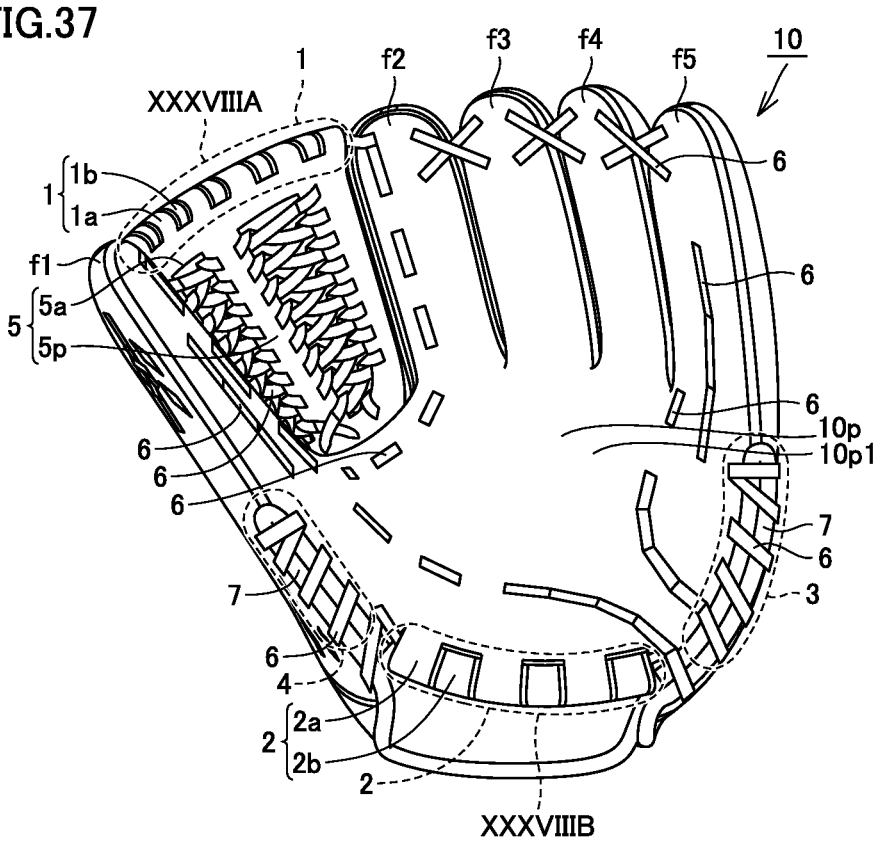
FIG. 37 is a schematic diagram showing the configuration of a region including a ball catching plane leather disposed on the palm side of the user's hand according to a ball catching tool of the twelfth embodiment.
Figure 38A:
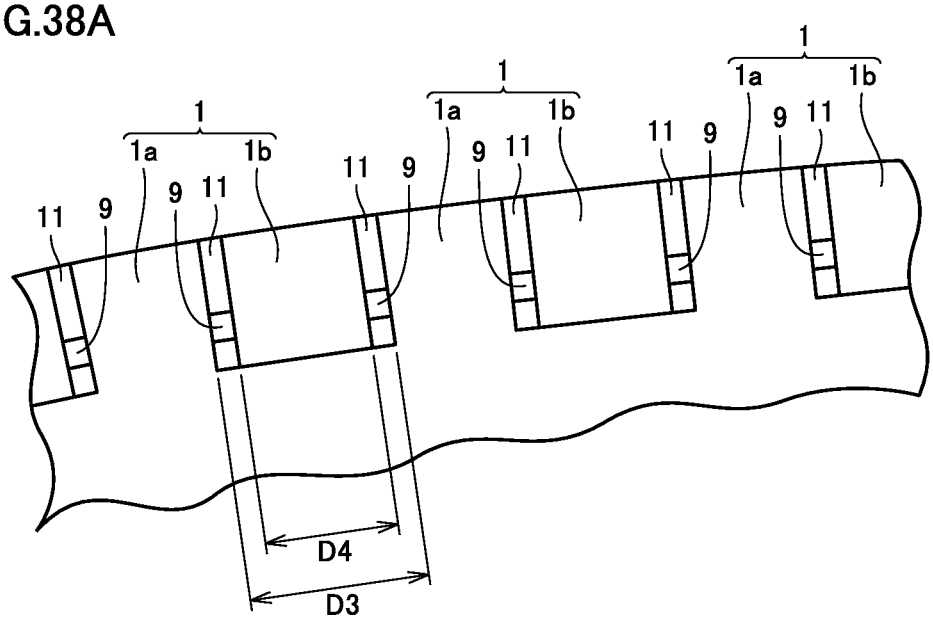
FIG. 38A is a schematic enlarged view of a region XXXVIIIA surrounded by a dotted line in FIG. 37.

Referring to FIGS. 37 and 38A showing still another modification, web loop 1*b* disposed adjacent to web loop 1*a* may be disposed only in a part of a region sandwiched between one web loop 1*a* and another web loop 1*a* adjacent thereto.

For example, in each of the embodiments described above, web loop 1*b* is disposed in an area corresponding to a distance D3 between one web loop 1*a* among a plurality of web loops 1*a* and another web loop 1*a* adjacent thereto such that this web loop 1*b* has a width almost equal to distance D3.

On the other hand, in the present embodiment, as compared with distance D3 between one web loop 1*a* among a plurality of web loops 1*a* and another web loop 1*a* adjacent thereto, a width D4 of web loop 1*b* located in the area corresponding to distance D3 is relatively small. Accordingly, a gap 11 exists between web loop 1*a* and web loop 1*b*, and loop penetration string 9 passing through web loop 1*a* and web loop 1*b* is exposed from gap 11. Such a configuration may be provided.

Figure 38B:
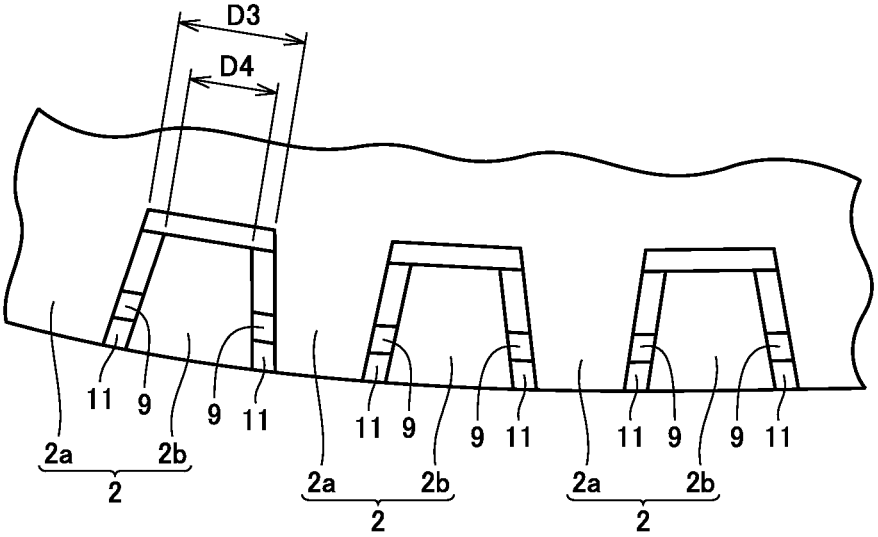
FIG. 38B is a schematic enlarged view of a region XXXVIIIB surrounded by the dotted line in FIG. 37

Furthermore, referring to FIGS. 37 and 38B, hand insertion portion loop 2*b* disposed adjacent to hand insertion portion loop 2*a* may be disposed only in a part of a region sandwiched between one hand insertion portion loop 2*a* and another hand insertion portion loop 2*a* adjacent thereto.

For example, in each of the embodiments described above, hand insertion portion loop 2*b* is disposed in an area corresponding to distance D3 between one hand insertion portion loop 2*a* among a plurality of hand insertion portion loops 2*a* and another hand insertion portion loop 2*a* adjacent thereto such that this hand insertion portion loop 2*b* has a width almost equal to this distance D3.

On the other hand, in the present embodiment, as compared with distance D3 between one hand insertion portion loop 2*a* among a plurality of hand insertion portion loops 2*a* and another hand insertion portion loop 2*a* adjacent thereto, a width D4 of hand insertion portion loop 2*b* located in an area corresponding to this distance D3 is relatively small. Accordingly, gap 11 exists between hand insertion portion loop 2*a* and hand insertion portion loop 2*b*, and loop penetration string 9 passing through hand insertion portion loop 2*a* and hand insertion portion loop 2*b* is exposed from gap 11. Such a configuration may be provided.

Characteristic configurations of the invention of the present application, which are partially the same as those in the embodiments described above, will be hereinafter listed.

[1] A glove (10) according to the present invention is a baseball or softball catching tool and includes: a first leather member (5*p*, 10*p*1, 10*p*) on a side of a ball catching plane; a second leather member (5*b*, 10*p*2, 10*b*) disposed to face the first leather member (5*p*, 10*p*1, 10*p*); and a connection portion (1, 2, 3, 4) in which the first leather member (5*p*, 10*p*1, 10*p*) and the second leather member (5*b*, 10*p*2, 10*b*) are connected at a part of an outer peripheral portion of the ball catching plane. The connection portion (1, 2, 3, 4) includes: a first loop (1*a*, 2*a*, 3*a*, 4*a*) contiguous to the first leather member (5*p*, 10*p*1, 10*p*) and having a central axis; a second loop (1*b*, 2*b*, 3*b*, 4*b*) disposed adjacent to the first loop (1*a*, 2*a*, 3*a*, 4*a*) in a direction along the central axis and contiguous to the second leather member (5*b*, 10*p*2, 10*b*); and a string member (9) passing through the first loop (1*a*, 2*a*, 3*a*, 4*a*) and the second loop (1*b*, 2*b*, 3*b*, 4*b*) along the central axis. At least one identical string member (9) passes through the first loop (1*a*, 2*a*, 3*a*, 4*a*) and the second loop (1*b*, 2*b*, 3*b*, 4*b*).

In this way, the connection portion (1, 2, 3, 4) can be readily bent, and thereby, caused to readily follow the movement of the user's hand. Therefore, the glove (10) can be bent with relatively smaller force, so that the ball catching action can be more readily carried out.

[2] According to the glove (10) described in the above [1], the first loop (1*a*, 2*a*, 3*a*, 4*a*) is provided integrally with the first leather member (5*p*, 10*p*1, 10*p*), and the second loop (1*b*, 2*b*, 3*b*, 4*b*) is provided integrally with the second leather member (5*b*, 10*p*2, 10*b*).

In this way, the process can be further simplified, for example, as compared with the case where the above-mentioned members are separately provided.

[3] According to the glove (10) described in the above (1), the first loop (1*a*, 2*a*, 3*a*, 4*a*) is provided separately from the first leather member (5*p*, 10*p*1, 10*p*), and the second loop (1*b*, 2*b*, 3*b*, 4*b*) is provided separately from the second leather member (5*b*, 10*p*2, 10*b*).

In this way, for example, the first loop (1*a*, 2*a*, 3*a*, 4*a*) can be formed to be thicker than the first leather member (5*p*, 10*p*1, 10*p*) while the second loop (1*b*, 2*b*, 3*b*, 4*b*) can be formed to be thicker than the second leather member (5*b*, 10*p*2, 10*b*). Furthermore, the (first or second) loop and the (first or second) leather member are separately formed, for example, thereby allowing the loop and the leather member to be formed by different members, so that flexibility of material selection can be increased.

[4] According to the glove (10) described in the above [1], the first loop (1*a*, 2*a*, 3*a*, 4*a*) is provided integrally with the first leather member (5*p*, 10*p*1, 10*p*) while the second loop (1*b*, 2*b*, 3*b*, 4*b*) is provided separately from the second leather member (5*b*, 10*p*2, 10*b*), or the first loop (1*a*, 2*a*, 3*a*, 4*a*) is provided separately from the first leather member (5*p*, 10*p*1, 10*p*) while the second loop (1*b*, 2*b*, 3*b*, 4*b*) is provided integrally with the second leather member (5*b*, 10*p*2, 10*b*).

In this way, for example, as to the portion having the (first or second) loop and the (first or second) leather member separately provided, the loop is formed to be thicker than the leather member as required, thereby allowing improvement in durability of this portion. In addition, the loop is formed to be thinner than the leather member as required, thereby allowing this portion to be readily bent. By freely adjusting the thickness of any required portion as necessary, the desired characteristics can be improved.

[5] According to the glove (10) described in the above [3], the first loop (1*a*, 2*a*, 3*a*, 4*a*) is different in thickness from the first leather member (5*p*, 10*p*1, 10*p*), and the second loop (1*b*, 2*b*, 3*b*, 4*b*) is different in thickness from the second leather member (5*b*, 10*p*2, 10*b*).

In this way, for example, as to the portion having the (first or second) loop and the (first or second) leather member separately provided, the loop is formed to be thicker than the leather member as required, thereby allowing improvement in durability of this portion. Also, the loop is formed to be thinner than the leather member as required, thereby allowing this portion to be readily bent.

In this way, the connection portions (1, 2, 3, 4) can be improved in strength.

[6] According to the glove (10) described in the above [1] to [5], the connection portion (2) is provided in a hand insertion portion into which a hand of a user is inserted.

In this way, the connection portion (2) can be readily bent, so that the user' ball catching action can be further readily carried out.

[7] According to the glove (10) described in the above [1] to [6], the connection portion (1) is provided in a web portion (5) provided between a portion receiving a thumb of the user and a portion receiving a forefinger of the user.

In this way, the connection portion (1) can be readily bent, so that the user's ball catching action can be further readily carried out.

[8] According to the glove (10) described in the above [1] to [7], the connection portion (3, 4) is provided in a portion of the outer peripheral portion that is adjacent to the hand insertion portion.

In this way, the connection portion (3, 4) can be readily bent, so that the user's ball catching action can be further readily carried out.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A baseball or softball catching tool adapted to be worn on a hand of a wearer comprising:

a first leather member on a side of a ball catching plane;

a second leather member disposed on a second side of the ball catching plane adjacent to the hand of the wearer of the catching tool and disposed to face said first leather member; and a connection portion in which said first leather member wherein the second leather member is disposed between the first leather member and the hand of the wearer substantially parallel to one another in layered arrangement and said second leather member are connected at a part of an outer peripheral portion of a heel portion of said ball catching tool between a thumb stall and a little finger stall, said connection portion including:

a first loop contiguous to said first leather member and having a central axis, a second loop disposed adjacent to said first loop in a direction along said central axis and contiguous to said second leather member, a string member passing through said first loop and said second loop along said central axis, said string member extends from inside of said first loop into said second loop so as to pass through both of said first loop and said second loop; and first loop and said second loop each are provided in one or more of: a hand insertion portion into which a hand of a user wearing a glove is inserted, and a portion that is adjacent to the hand insertion portion.

2. The baseball or softball catching tool according to claim 1, wherein said first loop is provided integrally with said first leather member, and said second loop is provided integrally with said second leather member.

3. The baseball or softball catching tool according to claim 1, wherein said first loop is provided separately from said first leather member, and said second loop is provided separately from said second leather member.

4. The baseball or softball catching tool according to claim 3, wherein said first loop is different in thickness from said first leather member, and said second loop is different in thickness from said second leather member.

5. The baseball or softball catching tool according to claim 1, wherein said first loop is provided integrally with said first leather member while said second loop is provided separately from said second leather member, or said first loop is provided separately from said first leather member while said second loop is provided integrally with said second leather member.

6. The baseball or softball catching tool according to claim 1, wherein said connection portion is provided in a web portion provided between a portion receiving a thumb of a user and a portion receiving a forefinger of the user.

7. A baseball or softball catching tool adapted to be worn on a hand of a wearer comprising:

a first leather member on a palmar side of the ball catching tool;

a second leather member disposed on a second side of the ball catching plane adjacent to the hand of the wearer of the catching tool and disposed to face said first leather member wherein the second leather member is disposed between the first leather member and the hand of the wearer substantially parallel to one another in layered arrangement; and a connection portion in which said first leather member and said second leather member are connected at a heel portion of the palmar side of the ball catching tool, wherein the connection portion extends along the heel portion of the palmar side of the ball catching tool between a first wrist adjoining connection portion on a thumb stall and a second wrist adjoining connection portion on a little finger stall, said connection portion including:

a first loop contiguous to the first leather member and having a central axis;

a second loop, contiguous to the second leather member, disposed adjacent to said first loop and sharing the central axis; and a string member passing through the first loop and the second loop along the central axis.

* * * * *